US010827853B2

(12) United States Patent
Ma et al.

(10) Patent No.: US 10,827,853 B2
(45) Date of Patent: Nov. 10, 2020

(54) LOCKING DEVICES FOR PEGBOARD HOOKS, SLATWALL HOOKS, AND CROSSBAR HOOKS

(71) Applicant: Delta Lock Company, LLC, Bohemia, NY (US)

(72) Inventors: Alvin Ma, Irvine, CA (US); David R. Wachsman, Palm Beach Gardens, FL (US); Alan Rabinowitz, Long Valley, NJ (US)

(73) Assignee: Delta Lock Company, LLC, Bohemia, NY (US)

( * ) Notice: Subject to any disclaimer, the term of this patent is extended or adjusted under 35 U.S.C. 154(b) by 0 days.

(21) Appl. No.: 16/363,552

(22) Filed: Mar. 25, 2019

(65) Prior Publication Data

US 2019/0290023 A1 Sep. 26, 2019

Related U.S. Application Data

(60) Provisional application No. 62/648,135, filed on Mar. 26, 2018, provisional application No. 62/728,812, filed on Sep. 9, 2018.

(51) Int. Cl.

| | |
|---|---|
| ***A47F 5/08*** | (2006.01) |
| ***E05B 65/00*** | (2006.01) |
| ***E05B 63/00*** | (2006.01) |

(52) U.S. Cl.

CPC ..... *A47F 5/0861* (2013.01); *E05B 63/0013* (2013.01); *E05B 65/00* (2013.01)

(58) Field of Classification Search

CPC .... A47F 5/0846; A47F 5/0823; A47F 5/0861; A47F 5/0853; E05B 65/00; E05B 63/0013

See application file for complete search history.

(56) References Cited

U.S. PATENT DOCUMENTS

| | | | | | |
|---|---|---|---|---|---|
| 578,787 | A * | 3/1897 | Tily | A47F 5/0823 | 211/57.1 |
| 4,303,217 | A * | 12/1981 | Garfinkle | A47F 5/0823 | 248/220.42 |
| 4,607,753 | A * | 8/1986 | Radek | A47F 5/0846 | 211/189 |
| 4,678,151 | A * | 7/1987 | Radek | A47F 5/0846 | 211/59.1 |
| 4,882,868 | A * | 11/1989 | Fast | A47F 5/0869 | 40/642.01 |
| 4,889,304 | A * | 12/1989 | Glickman | A47F 5/0823 | 248/222.13 |
| 5,080,238 | A * | 1/1992 | Hochman | A47F 5/0869 | 211/106.01 |
| 5,109,992 | A * | 5/1992 | Miller | A47F 5/0823 | 211/59.1 |

(Continued)

*Primary Examiner* — Kimberley S Wright

(74) *Attorney, Agent, or Firm* — Gerald Hespos; Michael Porco; Matthew Hespos

(57) ABSTRACT

Locking devices for pegboard hooks, slatwall hooks, and crossbar hooks are provided. In one aspect, locking devices are provided for preventing a pegboard hook from being removed form a pegboard. In another aspect, locking devices are provided for preventing a slatwall hook from being removed form a slatwall. In another aspect, locking devices are provided for preventing a crossbar hook from being removed form a crossbar.

14 Claims, 46 Drawing Sheets

(56) References Cited

U.S. PATENT DOCUMENTS

| | | | | |
|---|---|---|---|---|
| 6,250,597 | B1 * | 6/2001 | Kuo | A47K 10/10 211/16 |
| 6,749,161 | B1 * | 6/2004 | Will | A47F 5/0846 211/57.1 |
| 7,753,217 | B2 * | 7/2010 | Lawson | A47F 5/0853 211/94.01 |
| 7,757,869 | B2 * | 7/2010 | Lawson | A47F 5/0846 211/59.1 |
| 7,900,781 | B2 * | 3/2011 | Baine | A47F 5/0838 211/106.01 |
| 8,240,623 | B2 * | 8/2012 | Collins | A47F 5/0846 211/87.01 |
| 2005/0121573 | A1 * | 6/2005 | Ahlund | A47F 5/0823 248/220.21 |
| 2008/0105636 | A1 * | 5/2008 | Lawson | A47F 5/0846 211/94.01 |
| 2008/0105637 | A1 * | 5/2008 | Lawson | A47F 5/0853 211/94.01 |
| 2010/0206825 | A1 * | 8/2010 | Johnston | A47F 5/0853 211/59.2 |
| 2018/0116427 | A1 * | 5/2018 | Gupta | A47B 96/061 |

* cited by examiner

700

180
184
182
190
186
172
188
192
191
179
176
170
174
171

179
180
184
182
170
172
174
171

182
190
186
188
192
191
179
178
170
174
171

LOCKING DEVICES FOR PEGBOARD HOOKS, SLATWALL HOOKS, AND CROSSBAR HOOKS

PRIORITY

The present application claims priority to U.S. Provisional Patent Application No. 62/648,135, filed on Mar. 26, 2018, entitled "LOCKING DEVICES FOR PEGBOARD HOOKS AND SLATWALL HOOKS", the contents of which are hereby incorporated by reference in its entirety. The present application also claims priority to U.S. Provisional Patent Application No. 62/728,812, filed Sep. 9, 2018, entitled "LOCKING DEVICES FOR PEGBOARD HOOKS AND SLATWALL HOOKS", the contents of which are hereby incorporated by references it its entirety.

TECHNICAL FIELD

The present disclosure relates generally to locking devices, and more particularly, to locking devices for pegboard hooks, slatwall hooks, and crossbar hooks.

BACKGROUND

In commercials settings, items are often displayed for sale on long protruding rods, such as pegboard hooks, slatwall hooks, or crossbar hooks, which are coupled to corresponding support structures, such as pegboards, slatwalls and crossbars, respectively. Locking devices may be employed for preventing items that are being displayed on the pegboard hooks, slatwall hooks, and/or crossbar hooks from being removed from the pegboard hooks slatwall hooks, and/or crossbar hooks. However, these locking devices do not prevent the pegboard hooks slatwall hooks, and/or crossbar hooks themselves from being removed from the support structures they are coupled to. Therefore, a need exists for locking devices that prevent pegboard hooks, slatwall hooks, and/or crossbar hooks from being removed from the corresponding support structures they are coupled to.

SUMMARY

Locking devices for pegboard hooks, slatwall hooks, and crossbar hooks are provided herein.

In one aspect of the present disclosure, a locking device is provided for preventing a pegboard hook from being removed from a pegboard, the locking device comprising: a housing including a first side, a second side, a slot and a surface, the slot extending from the first side to the second side of the housing and the surface disposed on the second side of the housing, the slot configured to receive a portion of the pegboard hook when the pegboard hook is coupled to the pegboard and the surface configured to be disposed adjacent to a surface of the pegboard; and at least one securing member for securing the housing to the pegboard and preventing the pegboard hook from being tilted and removed from the pegboard.

In another aspect of the present disclosure, a locking device is provided for preventing a crossbar hook from being removed from a crossbar, the locking device comprising: an upper housing including an interior; a lower housing including an interior; wherein, when the upper housing is coupled to the lower housing, the interior of the upper housing and the interior of the lower housing are configured to receive a base of the crossbar hook and at least a portion of the crossbar while the crossbar hook is coupled to the crossbar.

In another aspect of the present disclosure, a locking device is provided for preventing a crossbar hook from being removed from a crossbar, the locking device comprising: a clip housing including an interior, a first end and a second end, the first end and second end separated by a gap, the clip housing configured to be sufficiently flexible to enable the first end and the second end to be separated such that the interior of the housing receives a base of the crossbar hook and at least a portion of the crossbar while the crossbar hook is coupled to the crossbar and the housing is disposed around the base of the crossbar and the at least a portion of the crossbar hook, wherein an inner surface of the interior includes at least one recess configured to receive a protrusion of the base of the crossbar hook.

BRIEF DESCRIPTION OF THE DRAWINGS

The above and other aspects, features, and advantages of the present disclosure will become more apparent in light of the following detailed description when taken in conjunction with the accompanying drawings in which:

FIG. 2J is a side view of the locking device of FIG. 2A securing the pegboard hook to the pegboard in accordance with an embodiment of the present disclosure;

FIGS. 8L-8O. include various views of the locking device of FIGS. 8A-8E coupled to a slatwall hook in accordance with an embodiment of the present disclosure;

It should be understood that the drawings are for purposes of illustrating the concepts of the disclosure and are not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Locking devices for pegboard hooks, slatwall hooks, and crossbar hooks are provided.

Figure 1A:
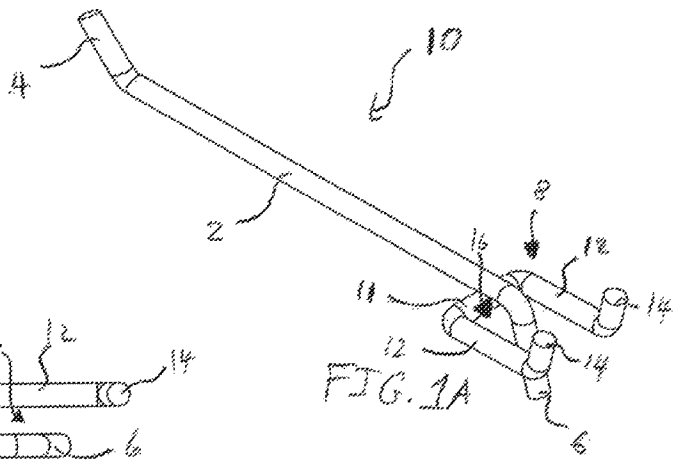
FIGS. 1A-C include various views of a pegboard hook in accordance with an embodiment of the present disclosure.
Figure 1B:
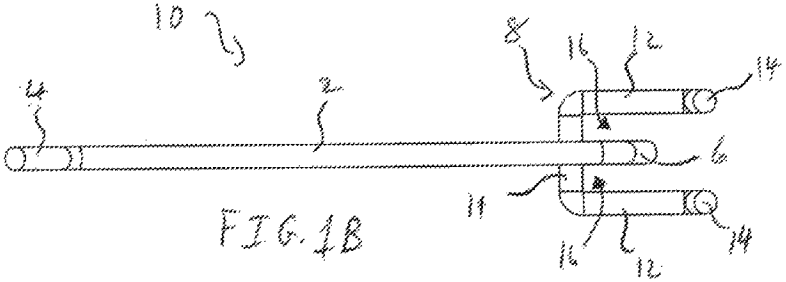
Figure 1C:
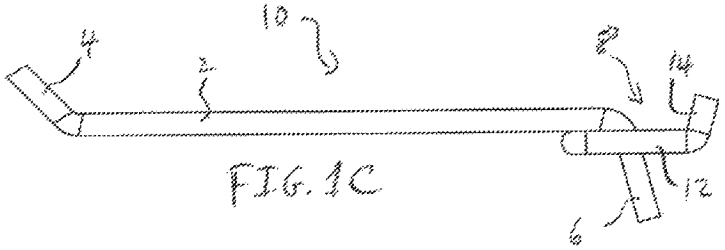

Referring to FIGS. 1A-C, pegboard hook 10 is shown in accordance with an embodiment of the present disclosure. Pegboard hook 10 includes a rod or wire portion 2 coupled to a u-shaped base 8. Rod 2 includes bent ends 4, 6, where ends 4, 6 are bent relative to rod 2 in opposing directions. Base 8 includes a central rod portion 11, which is aligned perpendicularly to rod 2. Base 9 further includes rod or wire portions 12, which extend perpendicularly from rod 11 in a direction away from rod 2. Each rod or wire 12 includes a bent end 14, where bent ends 14 are bent relative to rods or wires 12 in an opposite direction to end 6 of rod 2.

Figure 1D:
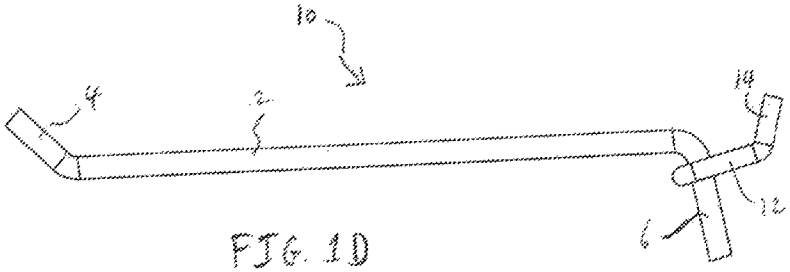
FIG. 1D is a side view of an alternative pegboard hook to the pegboard hook of FIGS. 1A-C in accordance with an embodiment of the present disclosure.

As shown in FIG. 1C, in one embodiment, rods 12 of base 8 extend essentially along the same axis as the linear portion of rod 2 (i.e., between bent ends 4, 6). Referring to FIG. 1D, in another embodiment, rod rods 12 of base 8 extend at an angle relative to the linear portion of rod 2.

In use, pegboard hook 10 is configured to be coupled to a pegboard. For example, referring to FIGS. 2A and 2B, a pegboard 30 is shown in in accordance with an embodiment of the present disclosure. Pegboard 30 includes a planar surface 30 having a plurality of apertures 34 spaced throughout surface 30. To couple hook 10 to pegboard 30, pegboard hook 10 is tilted (in a direction A shown in FIGS. 2A and 2B) such that bent ends 14 of base 8 can be inserted through adjacent apertures 34 of pegboard 30. Then, hook 10 is tilted (in a direction opposite to direction A) such that the linear portion of rod 2 extends substantially perpendicularly from surface 32. In this position, bent end 6 is disposed against surface 32 and prevents hook 10 from being tilted in a direction opposite to direction A. Bent ends 14 of base 8 are disposed adjacent against a surface opposite to surface 32 disposed on a rear portion of pegboard 30. Since ends 14 are bent relative to linear portion of rod 2 and rods 12, ends 14 prevent pegboard hook 10 from being removed from pegboard 30 unless rod 2 is titled in direction A allowing bent ends 14 to be removed from apertures 34.

Figure 2A:
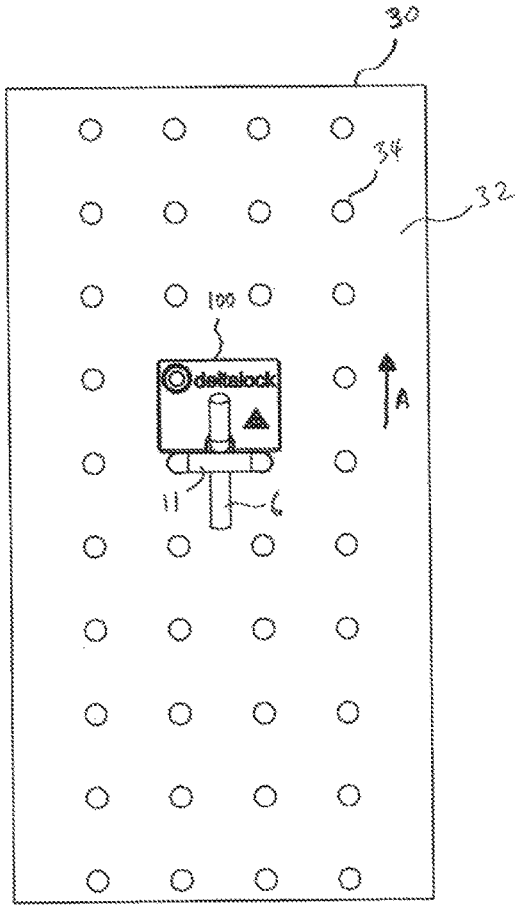
FIG. 2A is a front view of a pegboard hook coupled to a pegboard and a securing device for securing to the pegboard hook to the pegboard in accordance with an embodiment of the present disclosure.
Figure 2B:
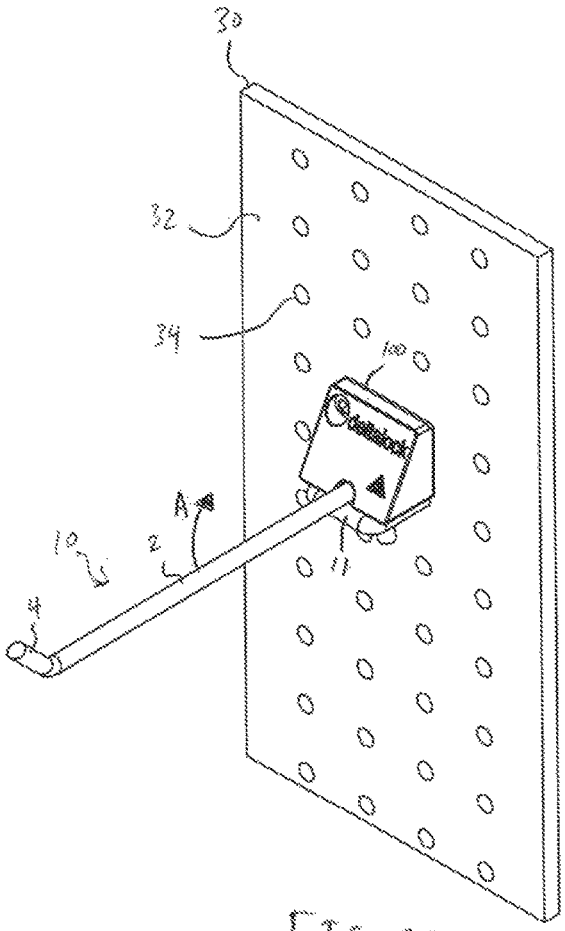
FIG. 2B is a perspective view of FIG. 2A in accordance with an embodiment of the present disclosure.
Figure 2C:
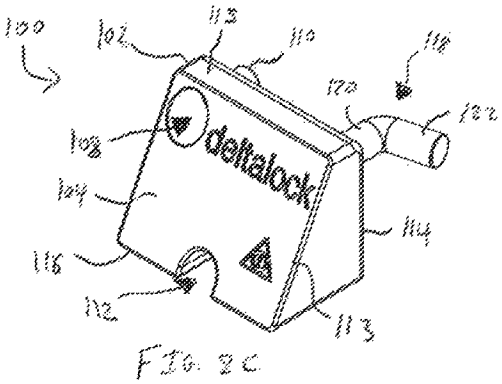
FIGS. 2C-2I include various views of the locking device of FIG. 2A in accordance with an embodiment of the present disclosure.
Figure 2I:
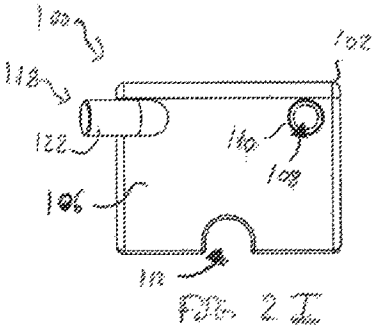
Figure 2H:
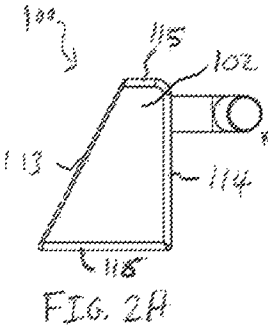
Figure 2D:
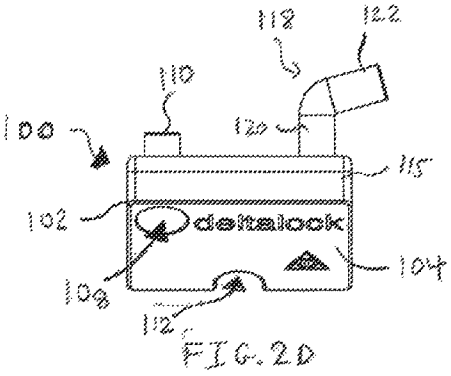
Figure 2E:
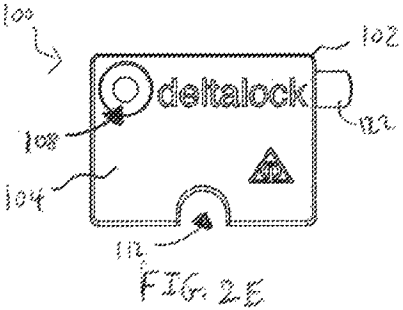
Figure 2F:
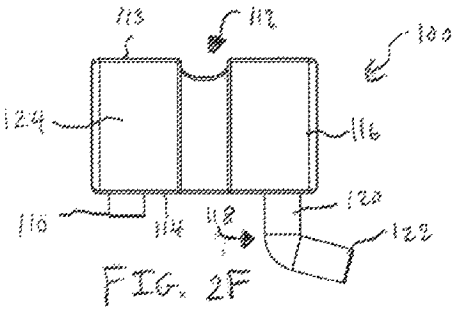
Figure 2G:
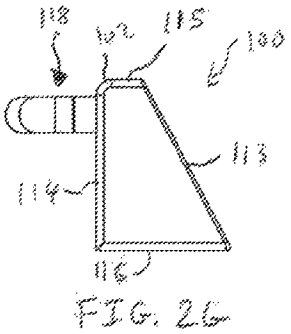
Figure 25:
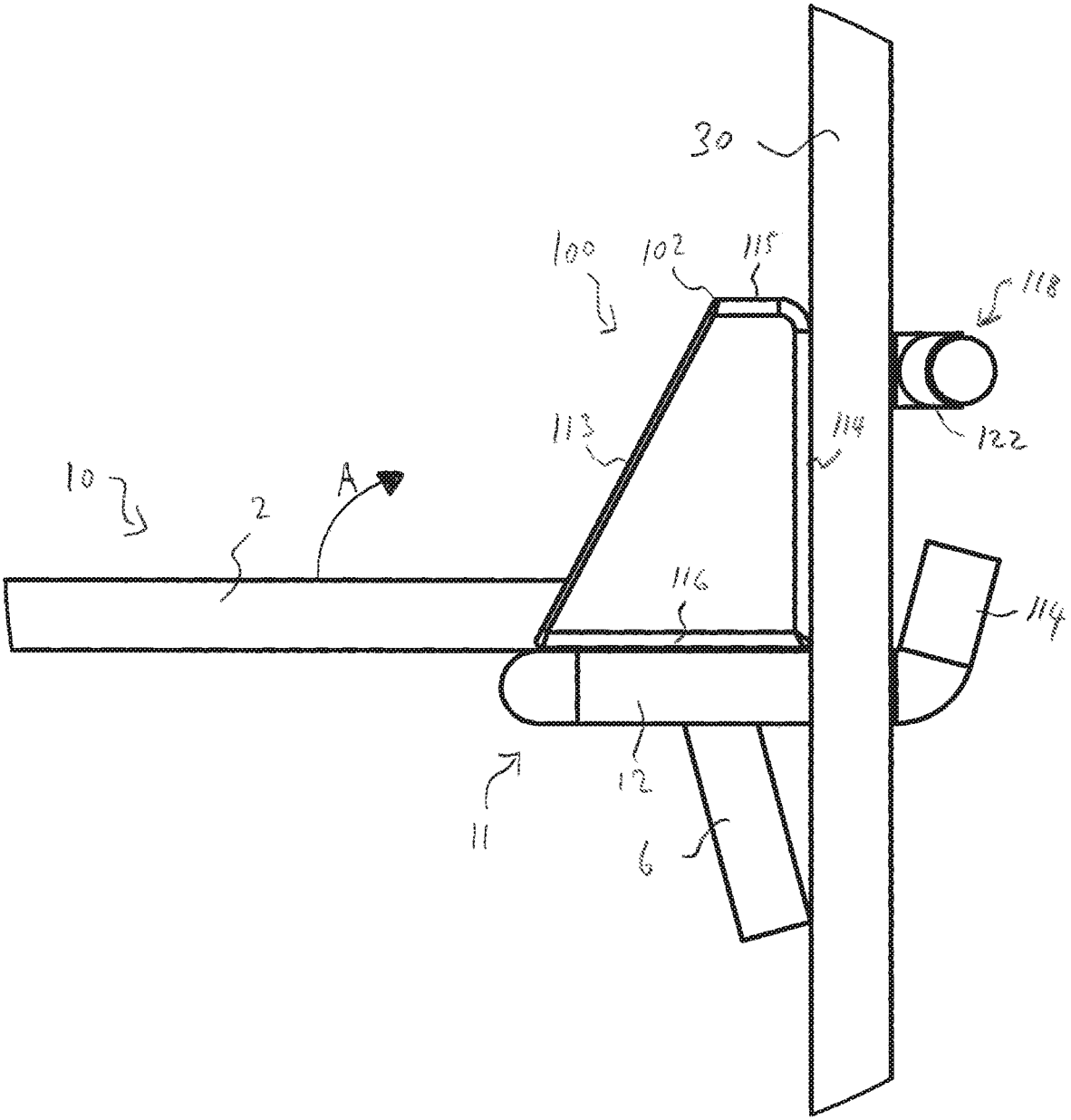

As shown in FIGS. 2A and 2B, in a first embodiment of the present disclosure, a locking device 100 for a pegboard hook 10 is provided. Locking device 100 is configured to prevent a pegboard hook 10 that is coupled to a pegboard 30 from being tilted in a direction A such that pegboard hook 10 cannot be removed from pegboard 30.

Referring to FIGS. 2D-2I, various views of locking device 100 are shown in accordance with the present disclosure. Device 100 includes a housing 102 having opposite sides 113, 114 and opposite ends 115, 116. Side 113 includes a surface 104, side 114 includes a surface 106, side 116 includes a surface 124. Surface 104 includes an aperture 108. A tubular member 110 extends substantially perpendicularly from surface 110. Device 100 also includes an arm 118 and a semi-circular slot 112. Arm 118 includes a first portion 120 and a second portion 122, where portion 120 extends substantially perpendicularly from surface 106 and portion 122 is bent relative to portion 120. Semi-circular slot 112 extends from side 113 to side 114 of housing 102.

Referring to FIGS. 2A, 2B, and 2J, device 100 is shown coupled to pegboard hook 10 and pegboard 30. In use, after pegboard hook 10 has been coupled to pegboard 30, locking device 100 is maneuvered such that arm 118 is inserted through an aperture 34 and locking device 100 is placed over pegboard hook 10, such that a portion of rod 2 is received by semi-circular slot 112 and surface 106 is disposed adjacent to surface 32. When surface 106 is disposed against surface 32, tubular member 110 extends through an adjacent aperture 34 to the aperture arm 118 is disposed through. To lock locking device 100, a screw or other securing member is inserted through aperture 108 and tubular member 110 and tightened. As shown in FIG. 2J, bent end 122 of arm 118 is disposed adjacent to a surface of pegboard 30 opposite to surface 32. The screw or securing member and bent end 122 of arm 118 together fixedly secure locking device 110 to pegboard 110 such that pegboard hook 10 cannot be tilted in a direction A and thus cannot be removed from pegboard 30 while device 100 is locked.

In another embodiment, locking device 100 includes a second rotatable arm. For example, referring to FIGS. 3A-3H locking device 100 is shown including a second arm 200 in accordance with another embodiment of the present disclosure. Arm 200 includes portions 202, 208, 210. Portion 202 includes an aperture 204. Portion 208 extends from portion 202 and is disposed between portions 202 and 210. Portion 210 is configured as a bent end of arm 200 and bends at an angle relative to portion 208. Surface 106 of housing 102 includes a slot 201 configured to rotatably receive portion 202 of arm 200. While portion 202 is disposed in slot 201, a screw or other securing means is disposed through apertures 108 and 204 to maintain portion 202 within slot 201 and control the rotation of arm 200. The inner dimensions of slot 201 (e.g., the inner walls) are configured to determine range of rotation of arm 200. In one embodiment, slot or cavity 201 is configured to enable arm 200 to be rotatable approximately 180 degrees.

Figure 3A:
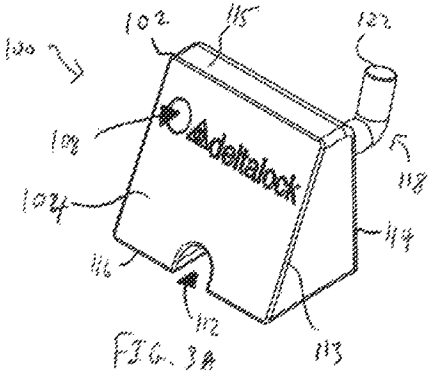
FIGS. 3A-3G include various views of another locking device for securing a pegboard hook to a pegboard in accordance with an embodiment of the present disclosure.
Figure 3G:
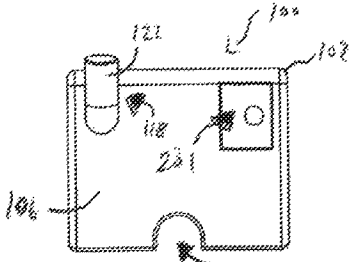
Figure 3H:
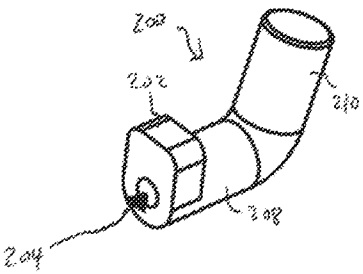
FIG. 3H is a perspective view of a rotatable arm of the locking device of FIGS. 3A-3G in accordance with an embodiment of the present disclosure.
Figure 3F:
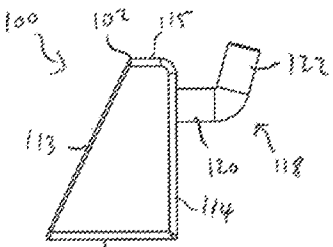
Figure 3B:
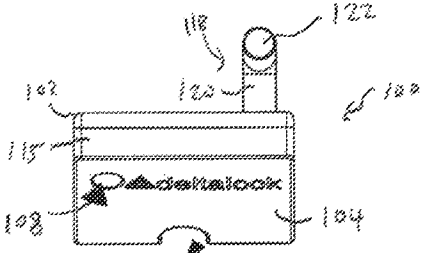
Figure 3C:
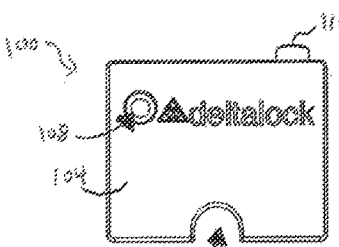
Figure 3D:
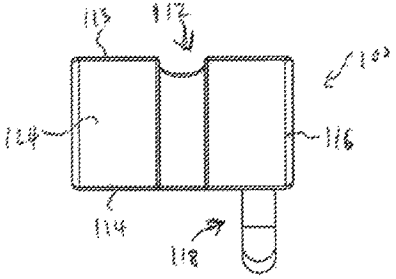
Figure 3E:
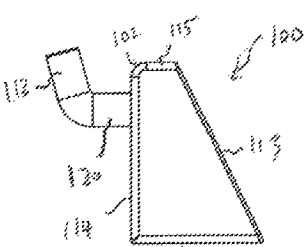
Figure 3I:
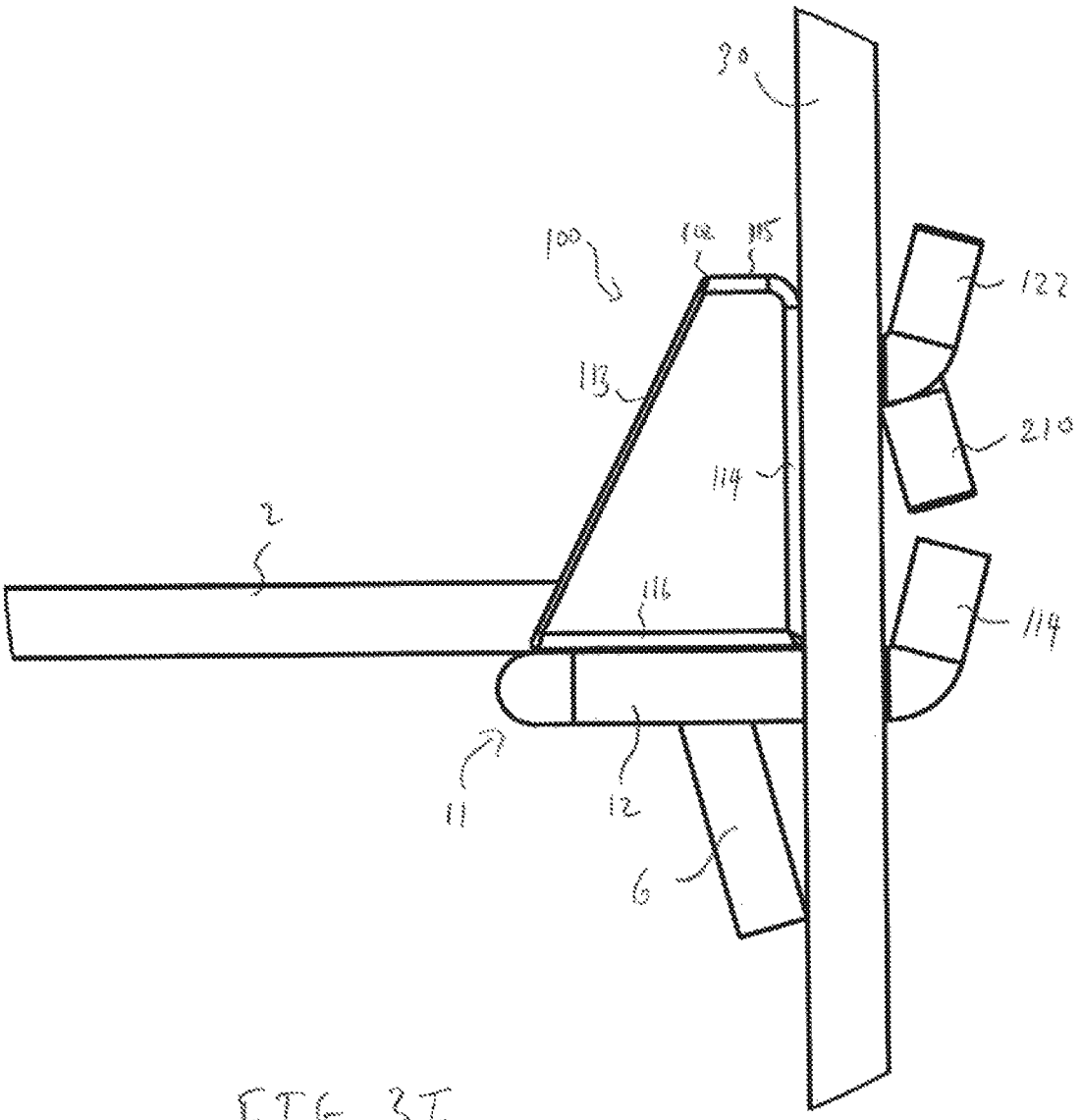
FIG. 3I is a side view of the locking device of FIGS. 3A-3G securing the pegboard hook to the pegboard in accordance with an embodiment of the present disclosure.

To lock the locking device 100 shown in FIGS. 3A-3D, initially arm 200 is rotated (via rotation of the screw or other securing means) such that bent ends 122 and 210 of arms 118, 200 are oriented in an upward direction toward end 115 of device 100. Device 100 is then maneuvered such that arms 118, 200 can be inserted through adjacent apertures 34 of pegboard 30. Device 100 is then placed over pegboard hook 10, such that a portion of rod 2 is received by semi-circular slot 112 and surface 106 of device 100 is disposed against surface 32 of pegboard 30. Then, rotatable arm 200 is rotated (via rotation of the screw or other securing means) until bent end 210 of rotatable arm 200 is oriented in a different direction than bent end 122 of arms 118. In one embodiment, arm 200 is configured to be rotated 180 degrees such that bent end 122 of arm 118 and bent end 210 of arm 200 can be oriented in opposite direction. For example, referring to FIG. 3I, locking device 100 is shown in a locked or secured state while being secured to pegboard hook 10 and pegboard 30. As shown in FIG. 3I, bent end 122 is oriented toward end 115 of housing 102 and bent end 210 has been rotated to be oriented toward end 116 of housing 102. Since bent ends 122, 210 of arms 118, 200 are oriented in opposite directions, locking device 100 is prevented from being removed from pegboard 30 by arms 118, 200. Furthermore, bent ends 122, 210 of arms 118, 20 being oriented in opposite directions prevent pegboard hook 10 from being tilted and, therefore, prevent pegboard hook 10 from being removed from pegboard 30.

Figure 4A:
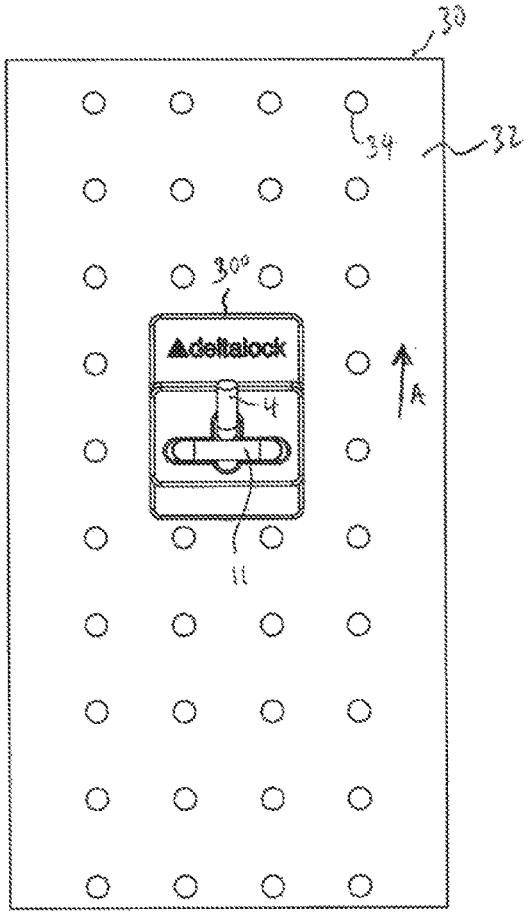
FIG. 4A is a front view of a pegboard hook coupled to a pegboard and yet another securing device for securing to the pegboard hook to the pegboard in accordance with an embodiment of the present disclosure.
Figure 4B:
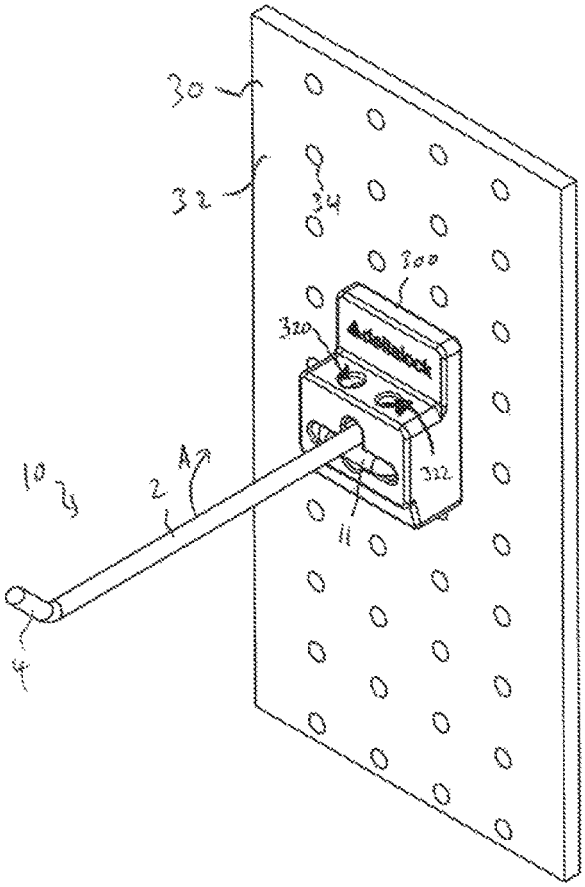
FIG. 4B is a perspective view of FIG. 4A in accordance with an embodiment of the present disclosure.
Figure 4C:
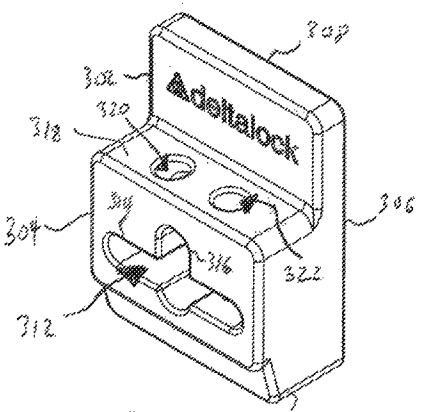
FIGS. 4C-4I include various views of the locking device of FIG. 4A in accordance with an embodiment of the present disclosure.
Figure 4I:
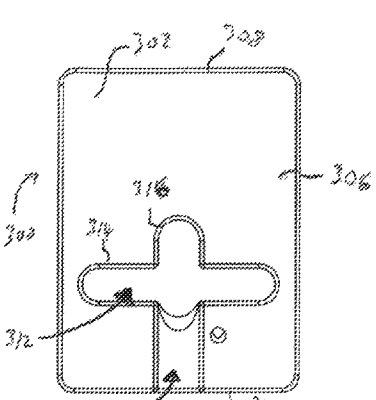
Figure 4H:
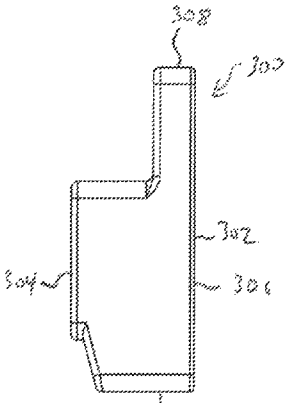
Figure 4D:
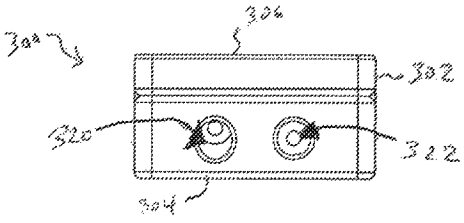
Figure 4E:
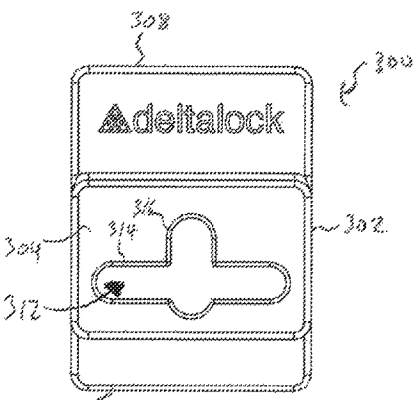
Figure 4F:
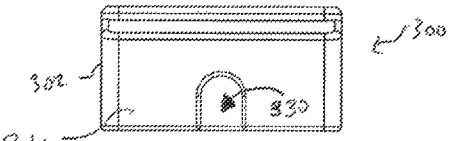
Figure 4G:
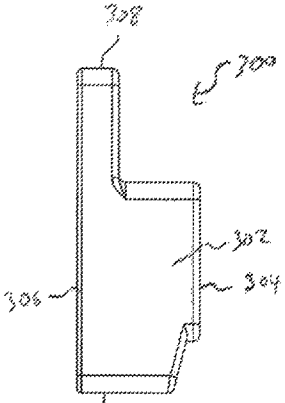
Figure 4J:
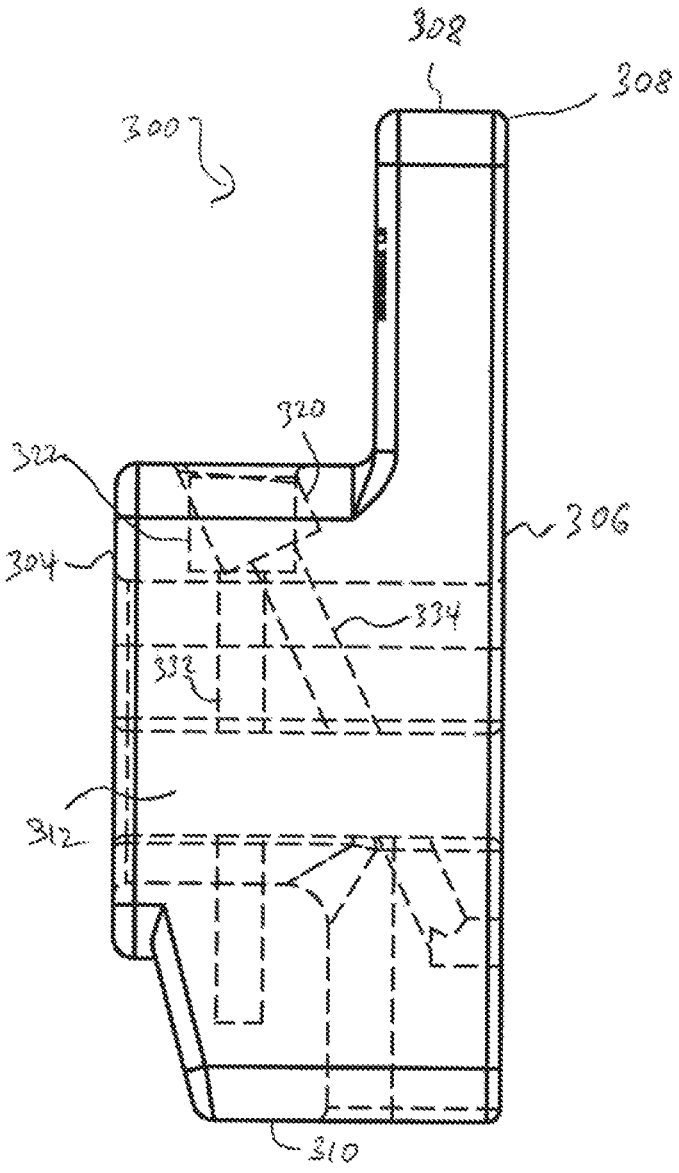
FIG. 4J is a side view of the locking device of FIG. 4A in phantom in accordance with an embodiment of the present disclosure.

Referring to FIGS. 4A-4B, a locking device 300 for securing a pegboard hook 10 to a pegboard 10 is shown in accordance with another embodiment of the present disclosure. Referring to FIGS. 4D-4J, various views of locking device 300 as shown. Locking device 300 includes a housing 302 having opposite ends 308, 310 and opposite sides 304, 306. Housing 302 includes peghook slot 312, which extends from side 304 to side 306 of housing 302. Slot 312 includes a horizontal portion 314 and a vertical portion 316 and is configured to receive pegboard hook 10, as will be described in greater detail below. As best seen in FIG. 4I, side 306 of housing 302 includes semi-circular slot 330, which extends from end 310 of housing 302 and merges into a portion of slot 312. Housing 302 includes apertures 320, 322 disposed through a surface 318. As best seen in FIG. 4J, aperture 320 provides access to a channel 334, where channel 334 extends from aperture 320 into and past slot 312 toward end 310 of housing 302. Aperture 322 provides access to a channel 332, where channel 332 extends from aperture 322 into and past slot 312 and toward end 310 of housing 302. It is to be appreciated that channel 334 extends at an angle relative to channel 332, such that as channel 334 extends end 306 toward end 310 of housing 310, channel 334 becomes progressively more proximately disposed toward side 306 of housing 302.

In use, after pegboard hook 10 has been coupled to pegboard 30 (in the manner described above), locking device 300 is disposed over pegboard hook 10 such that bent end 4 of pegboard hook 10 is inserted through side 306 of housing 302 and through slot 312 until side 306 of housing 302 is disposed against surface 32 of pegboard 30. It is to be appreciated that portion 314 of slot 312 is configured to enable base 8 of pegboard hook 10 to be inserted through and disposed in slot 312, portion 316 is configured to enable bent end 4 of pegboard hook 10 to be inserted through slot 312, and semi-circular slot 330 is configured to receive bent end 6 of pegboard hook 10 such that (planar) side 306 of housing 302 is enabled to contact planar surface 32. After device 300 has been disposed over pegboard hook 10, rods 11 and 12 of base 9 of pegboard hook 10 is disposed within slot 312.

Referring to FIGS. 1A and 1B, pegboard hook 10 includes two u-shaped slots 16, each formed between a portion of rods 11 and 12 and bent end 6 of rod 2. At least one of channels 322, 334 align with one of slots 16. As described above and shown in FIGS. 1C and 1D, the geometries of pegboard hook 10 may differ in that the rods 12 of base 8 may be aligned substantially along the same axis as the linear portion of rod 2 (as shown in FIG. 1C) or at an angle relative to the linear portion of rod 2 (as shown in FIG. 1D). Channel 332 is configured for use with the configuration of pegboard hook 10 shown in FIG. 1C, while channel 334 is configured for use with the configuration of pegboard hook 10 shown in FIG. 1D. It is to be appreciated, that although two apertures 320, 322 and channels 332, 334 are shown in FIG. 4J, in other embodiments more or less channels may be added to accommodate pegboard hooks 10 with differing geometries using the same locking device 300.

Figure 4K:
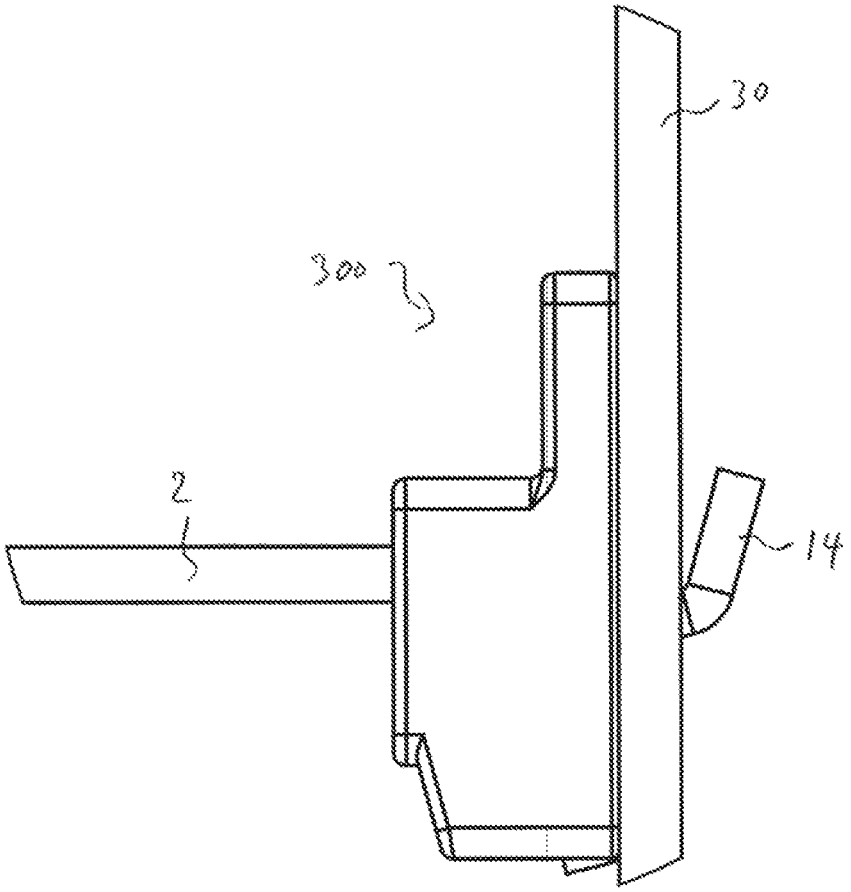
FIG. 4K is a side view of the locking device of FIG. 4A securing a pegboard hook to a pegboard in accordance with an embodiment of the present disclosure.

With base 8 disposed in slot 312, a screw or other securing means is inserted through one of apertures 320, 322 and channels 332, 334, such the screw is disposed through one of slots 16 of pegboard hook 10. With the screw or securing means disposed through one of channels 332, 334 and one of slots 16, locking device 300 is prevented from being removed from surface 32 of pegboard 30 because rod 11 prevents the screw or securing means from traveling in a direction away from surface 32. Additionally, pegboard hook 10 cannot be removed from pegboard 30, because while locking device 300 is disposed over pegboard hook 10 and secured to pegboard 30, pegboard 30 prevents pegboard hook 10 from being tilted in a direction A (shown in FIGS. 4A, 4B) because base 8 and a portion of rod 2 are disposed in slot 312 and planar side 6 being disposed against planar surface 32 prevents device 300 from being tilted. Also, as stated above, arms 14 of pegboard hook 10 prevent pegboard hook 10 from being pulled in a direction away from surface 32 because arms 14 bend behind a rear surface of pegboard 30 (as illustrated in FIG. 4K). Furthermore, bent end 6 of pegboard hook 10 being disposed against surface 32 prevents pegboard hook 10 from being pushed in a direction toward surface 32.

Figure 9B:
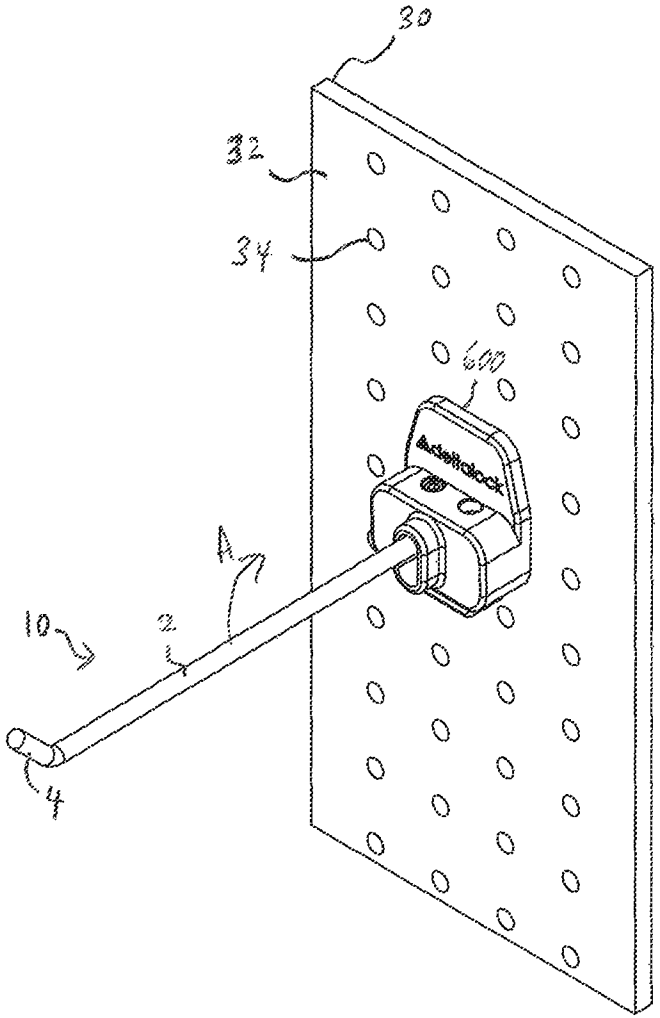
FIG. 9B is a perspective view of FIG. 9A in accordance with an embodiment of the present disclosure.
Figure 9A:
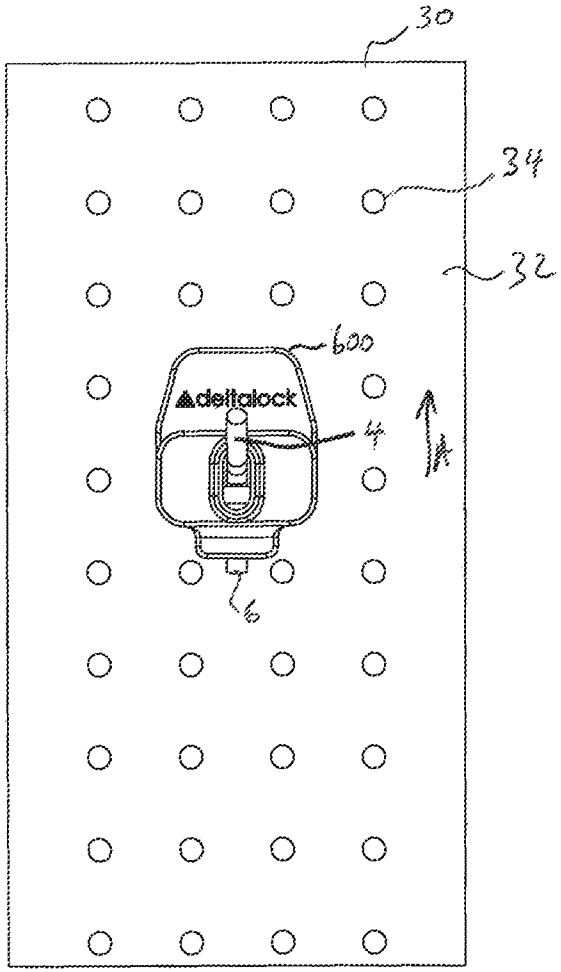
FIG. 9A is a front view of a pegboard hook coupled to a pegboard and yet another securing device for securing the pegboard hook to the pegboard in accordance with an embodiment of the present disclosure.
Figure 9C:
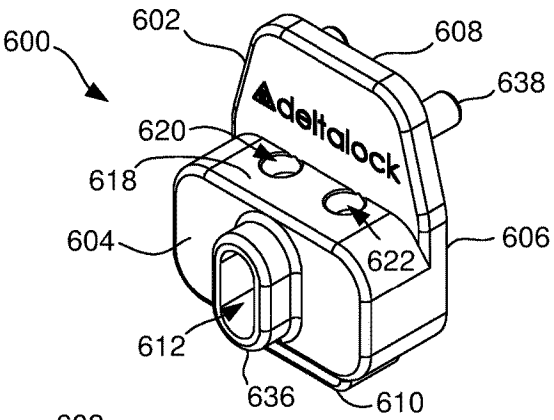
FIGS. 9C-9I include various views of the locking device of FIG. 9A in accordance with an embodiment of the present disclosure.

Referring to FIGS. 9A-9B, a locking device 600 for securing a pegboard hook 10 to a pegboard 30 is shown in accordance with another embodiment of the present disclosure. Referring to FIGS. 9C-9J, various views of locking device 600 are shown.

Locking device 600 includes a housing 602 having opposite ends 608, 610 and opposite sides 604, 606. Housing 602 includes an extension member 636 which extends away from housing 602. Housing 602 further includes arms 638, 640, surfaces 618, 607, slots 612, 630, and apertures 620, 622, and channels 630, 632. Arms 638, 640 are disposed on side 606 of housing 602 and extend in a direction away from housing 602. Arms 638, 640 are configured to be disposed through respective apertures 34 of pegboard 30. Peghook slot 612 extends from side 604 to side 606 of housing 602. The end of slot disposed on side 606 of housing 602 includes a horizontal portion 614 and a vertical portion 616 and is configured to receive pegboard hook 10, as will be described in greater detail below. Vertical portion 616 extends from side 606 to side 604 of housing 602 and horizontal portion 614 extends from side 606 into the interior of housing 602, terminating before reaching side 604.

Figure 9I:
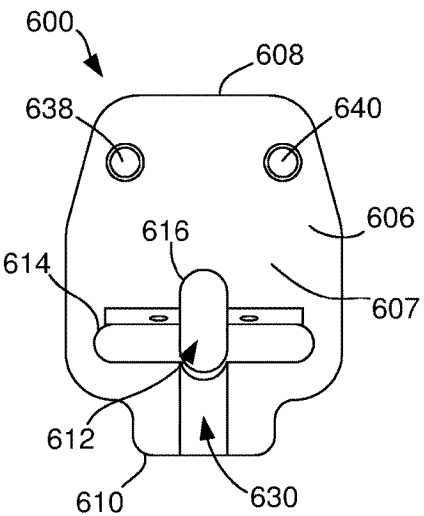
Figure 9H:
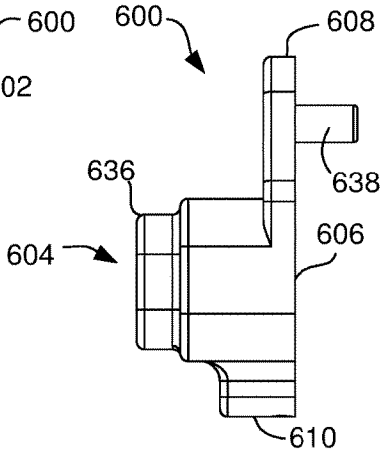
Figure 9D:
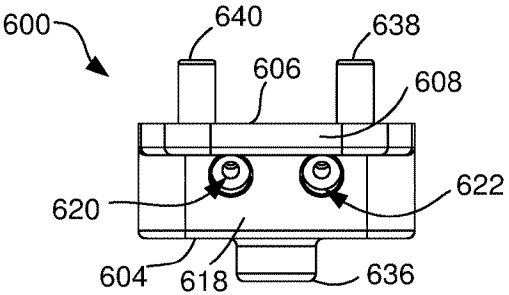
Figure 9E:
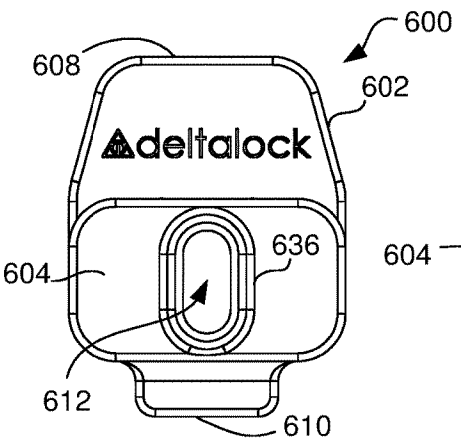
Figure 9F:
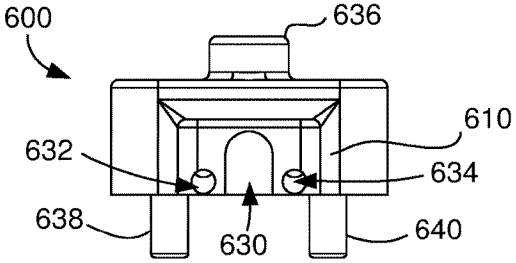
Figure 9G:
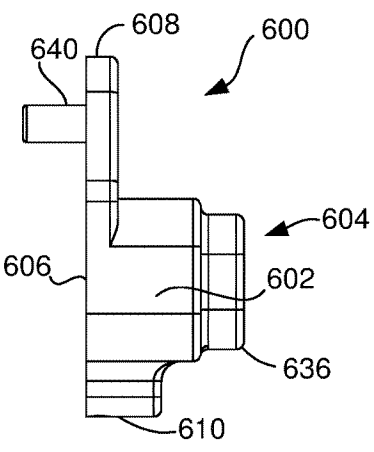
Figure 9J:
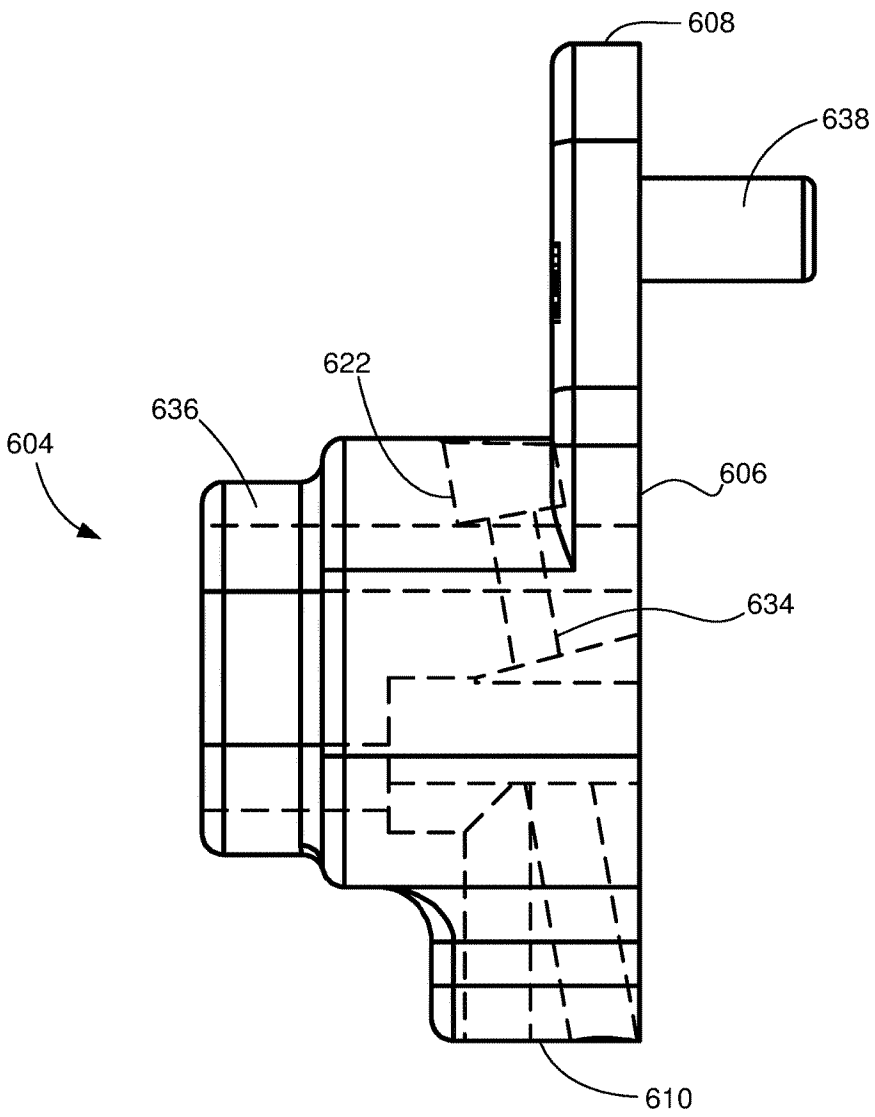
FIG. 9J is a side view of the locking device of FIG. 9A in phantom in accordance with an embodiment of the present disclosure.

As best seen in FIG. 9I, side 606 of housing 602 includes semi-circular slot 630 embedded in planar surface 607, which extends from end 610 of housing 602 toward end 608 of housing 602 and merges into a portion of slot 612. Apertures 620, 622 disposed through a surface 618. As best seen in FIG. 9J, aperture 622 provides access to a channel 634, where channel 634 extends from aperture 622 into and past (i.e., traverses) slot 612 to end 610 of housing 602. As best seen in FIG. 9F, similar to aperture 622, aperture 620 provides access to another channel 632, where channel 632 extends from aperture 620 into and past (i.e., traverses) slot 612 and to end 610 of housing 602. It is to be appreciated that, in one embodiment, both channels 632, 634 extend at an angle, such that as each of channels 632, 634 extend towards end 610 of housing 602, both channels 632, 634 become progressively more proximately disposed toward side 606 of housing 602.

In use, after pegboard hook 10 has been coupled to pegboard 30 (in the manner described above), locking device 600 is disposed over pegboard hook 10 such that bent end 4 of pegboard hook 10 is inserted through side 606 of housing 602 and through slot 612 until surface 607 of side 606 of housing 602 is disposed against surface 32 of pegboard 30 and arms 638, 640 are disposed through respective apertures 34 of pegboard 30. It is to be appreciated that portion 614 of slot 612 is configured to enable base 8 of pegboard hook 10 to be inserted through and disposed in slot 612, portion 616 is configured to enable bent end 4 of pegboard hook 10 to be inserted through slot 612 and exit from extension member 636, and semi-circular slot 630 is configured to receive bent end 4 of pegboard hook 10 such that planar surface 607 of side is enabled to contact planar surface 32. After device 600 has been disposed over pegboard hook 10, rods 11 and 12 of base 9 of pegboard hook 10 is disposed within slot 612.

Referring to FIGS. 1A and 1B, pegboard hook 10 includes two u-shaped slots 16, each formed between a portion of rods 11 and 12 and bent end 6 of rod 2. Channel 632 and 634 each align with one of the two slots 16. Channel 632 and 634 are each configured for use with the configurations of pegboard hook 10 shown in FIGS. 1C-1D. It is to be appreciated, that although two apertures 620, 622 and channels 632, 634 are shown in FIG. 9J, in other embodiments more or less apertures/channels may be added/subtracted and the angle the channels 632, 634 extend at may be altered to accommodate pegboard hooks 10 with differing geometries using the same locking device 600.

Figure 9K:
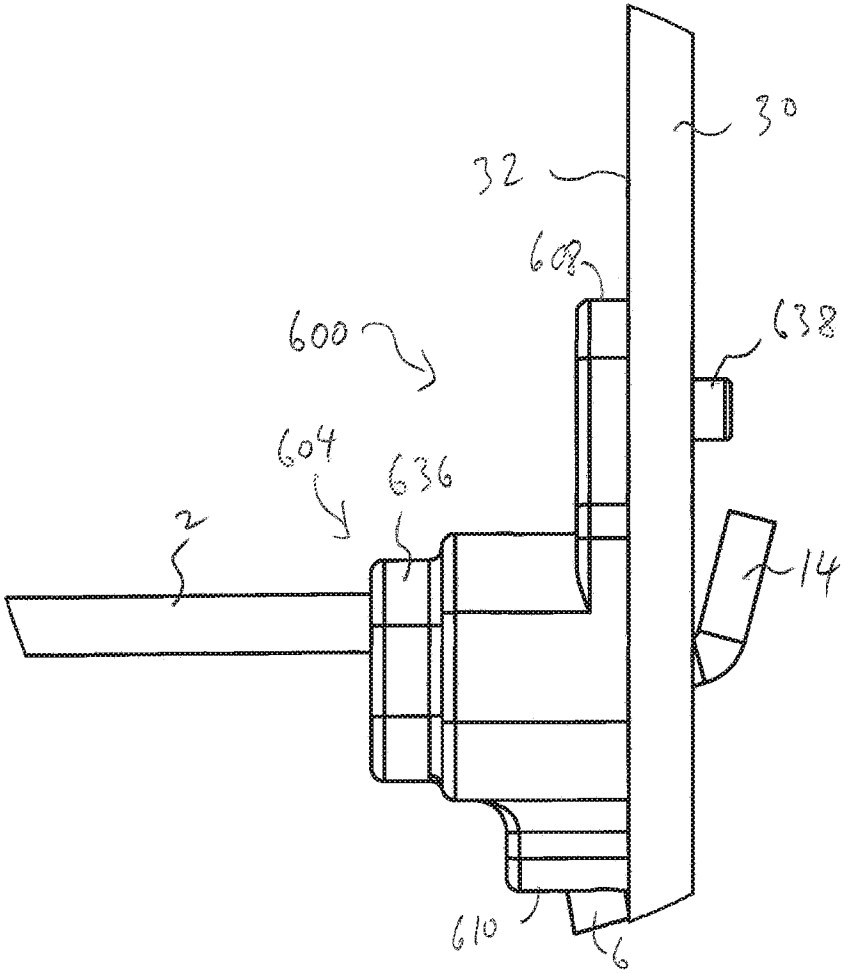
FIG. 9K is a side view of the locking device of FIG. 4A securing a pegboard hook to a pegboard in accordance with an embodiment of the present disclosure.

With base 8 disposed in slot 612, a screw or other securing means is inserted through either or both apertures 620, 622 and channels 632, 634, such that the screw or other securing means is disposed through one or both of slots 16 of pegboard hook 10. With the screw or securing means disposed through one or both of channels 632, 634 and one or both of slots 16, locking device 600 is prevented from being removed from surface 32 of pegboard 30 because rod 11 prevents the screw or securing means from traveling in a direction away from surface 32. Additionally, pegboard hook 10 cannot be removed from pegboard 30, because while locking device 600 is disposed over pegboard hook 10 and secured to pegboard 30, pegboard 30 prevents pegboard hook 10 from being tilted in direction A (shown in FIGS. 9A, 9B) because base 8 and a portion of rod 2 are disposed in slot 612 and planar side 6 being disposed against planar surface 32 prevents device 600 from being tilted. Arms 14 of pegboard hook 10 prevent pegboard hook 10 from being pulled in a direction away from surface 32 because arms 14 bend behind a rear surface of pegboard 30 (as illustrated in FIG. 9K). Arms 638, 640 of locking device 600 prevent housing 602 from being rotated or otherwise twisted with respect to surface 32. Furthermore, bent end 6 of pegboard hook 10 being disposed against surface 32 prevents pegboard hook 10 from being pushed in a direction toward surface 32 (FIGS. 9A, 9K).

Figure 5A:
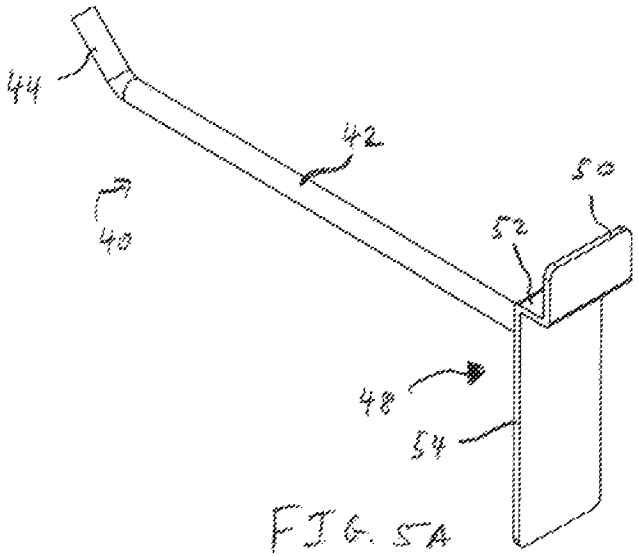
FIGS. 5A and 5B include a perspective and a side view of a slatwall hook in accordance with an embodiment of the present disclosure.
Figure 5B:
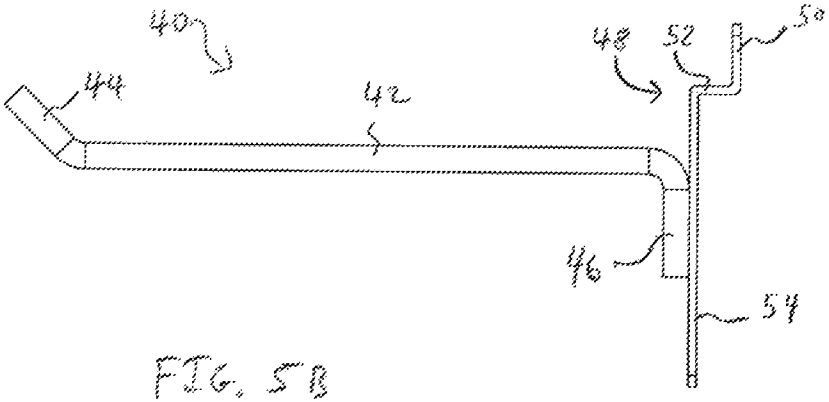
Figure 6A:
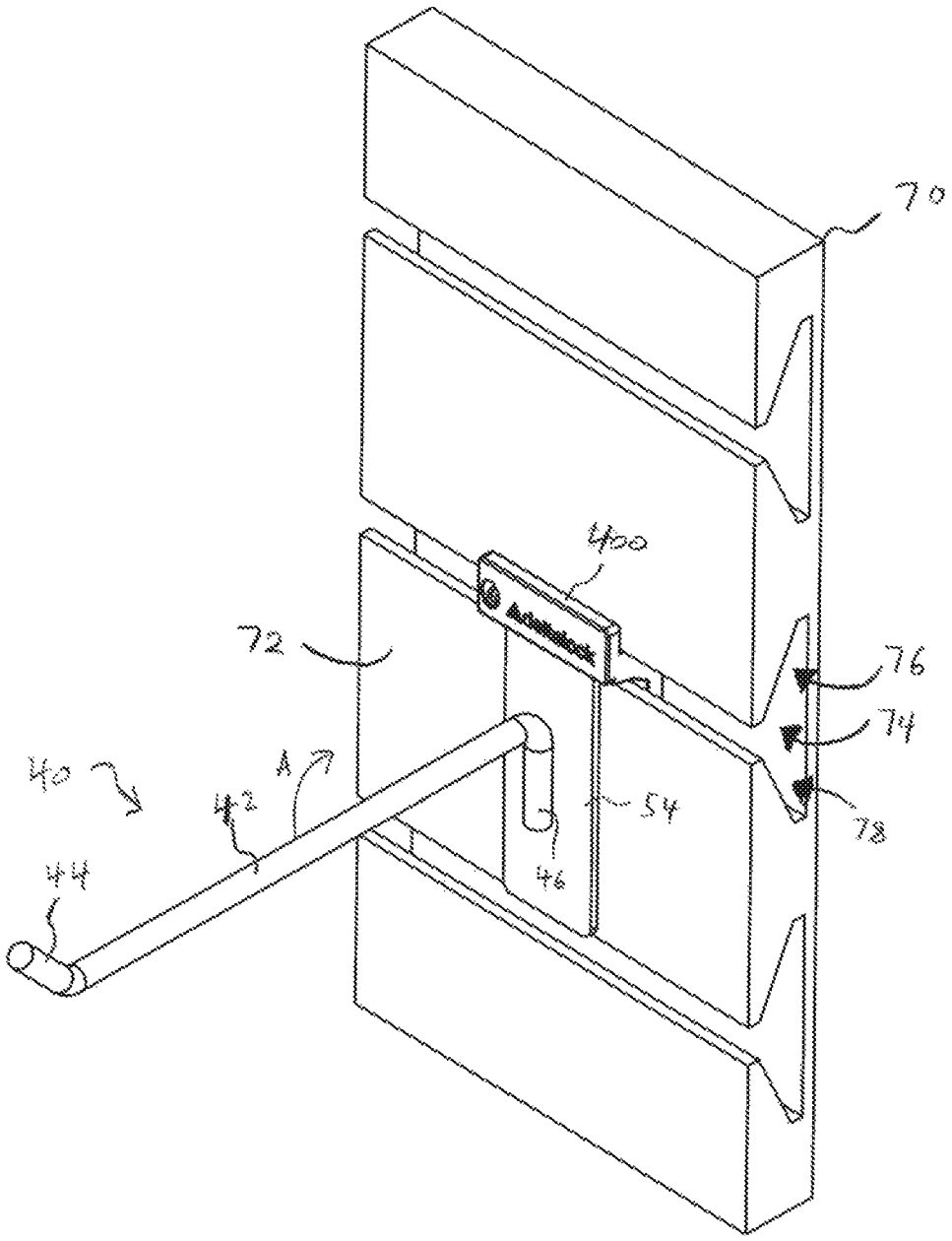
FIG. 6A is a perspective view of a locking device securing a slatwall hook to a slatwall in accordance with an embodiment of the present disclosure.
Figure 6B:
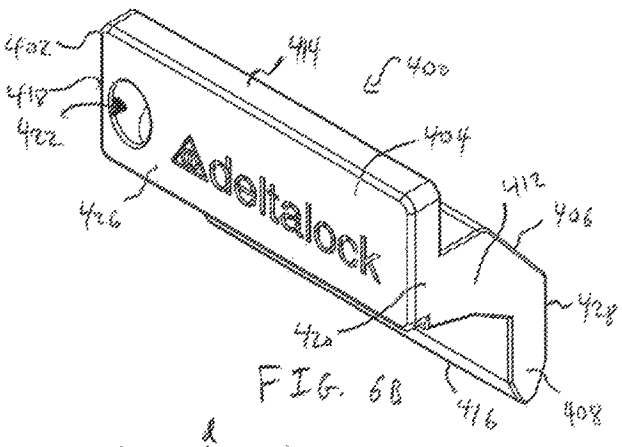
FIGS. 6B-6G include various view of the locking device of FIG. 6A in accordance with an embodiment of the present disclosure.
Figure 6C:
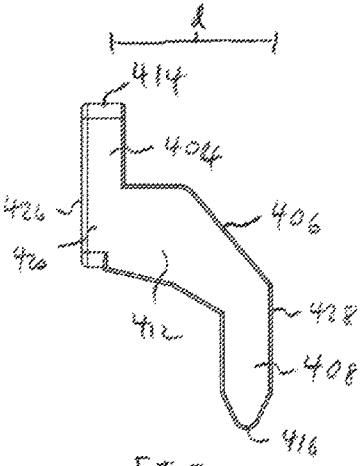
Figure 6G:
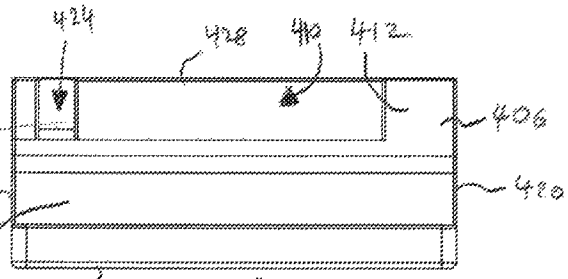
Figure 6D:
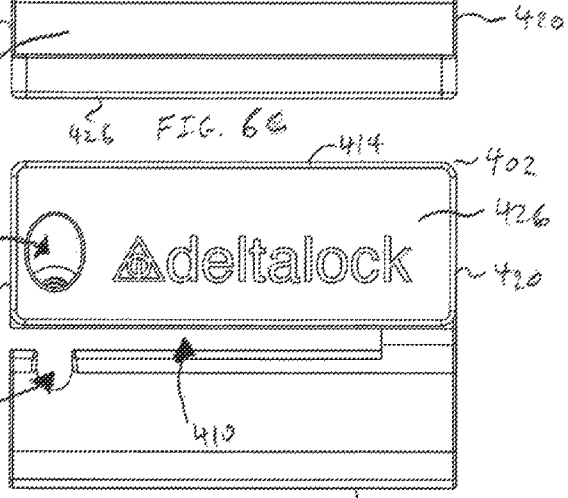
Figure 6E:
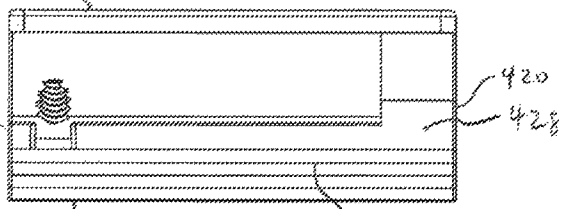
Figure 6F:
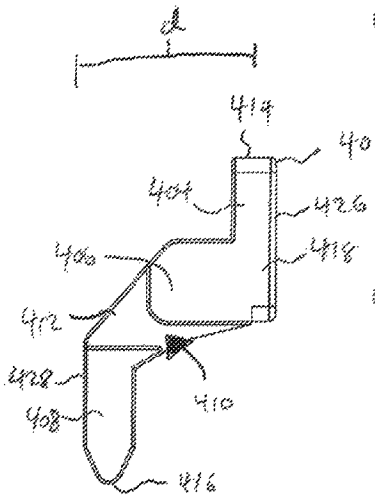

In addition to providing locking devices for pegboard hooks 10, the present disclosure also provides locking devices for securing slatwall hooks to slatwalls. For example, referring to FIGS. 5A and 5B, slatwall hook 40 is shown in accordance with the present disclosure. Slatwall hook 40 includes a rod or wire 42 having bent ends 44 and 46. Slatwall hook 40 further includes a base 48 coupled to bent end 46 of rod 42. Base 48 includes portions 50, 52, 54. Portions 50 and 52 are configured as substantially planar tabs which extend in a perpendicular direction relative to the linear portion of rod 42 (where the linear portion is disposed between bent ends 44, 46). Referring to FIG. 6A, slatwall hook 40 is shown coupled to a slatwall 70. Slatwall 70 includes a surface 72 and a plurality of slots 74, each slot 74 having an upper portion 76 and a lower portion 78. To couple slatwall hook 40 to slatwall 70, rod 42 is tilted in a direction A to enable tab 50 of hook 40 to be inserted into upper portion 76 of slot 74, such that tab 54 is disposed against surface 72 and rod 42 extends substantially perpendicularly from surface 72. To remove slatwall hook 40 from slatwall 70, rod 42 must be tilted in a direction A.

In one embodiment of the present disclosure, a locking device 400 (shown in FIG. 6A) is provided for locking and securing slatwall hook 40 to slatwall 70. Referring to FIGS. 6B-6G, various views of locking device 400 are shown in accordance with the present disclosure. Locking device 400 includes opposite ends 414, 416 and opposite sides 426, 428. Locking device 400 includes portions 404, 406, 408, where portion 404 is disposed toward end 414 and portion 408 is disposed toward end 416. Portions 404 and 408 are each configured as tabs that extend perpendicularly from portion 406 and are offset by a distance d (shown in FIGS. 6F and 6G). Distance d is selected based on the at least one of the offset distance between portions 50 and 52 of hook 40 (e.g., in one embodiment, distance d is substantially similar to the offset distance between portions 50 and 52) and/or the depth of slot 74. Device 400 includes a slot having two portions 422, 424, where portion 422 is disposed through portion 404 of housing 402 and portion 424 is disposed through portion 408 of housing 402. Portion 406 of housing 402 includes a bridge or connecting portion 412, which connects portion 404 to portion 408 of housing 402. Portion 412 of housing 402 further includes a slot 410 extending from side 418 of housing 402 toward side 420 of housing 402. It is to be appreciated that slot 410 terminates before reaching side 420 of housing 402.

Figure 6H:
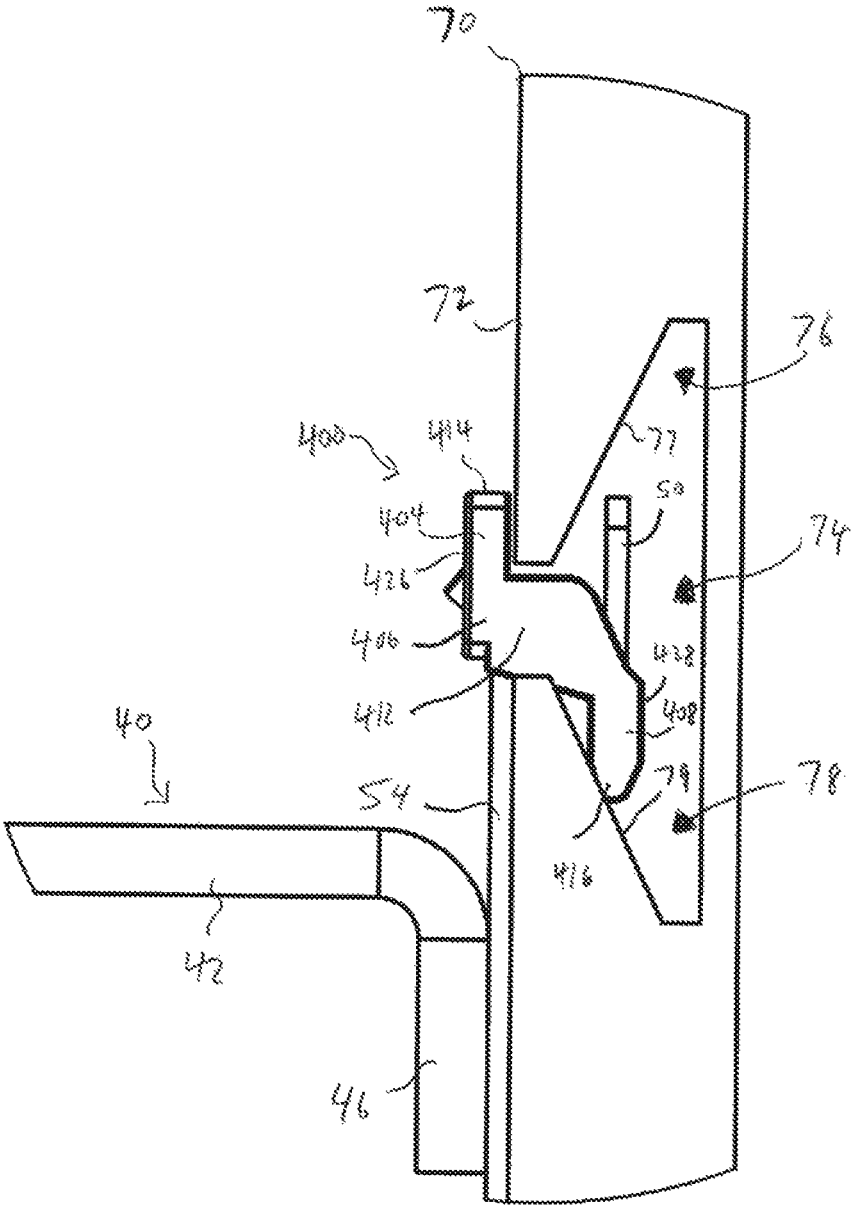
FIG. 6H is a side view of the locking device of FIG. 6A securing a slatwall hook to a slatwall in accordance with an embodiment of the present disclosure.

Referring to FIGS. 6A and 6H, tab portion 408 is configured to be inserted into the lower portion 78 of slot 74, such that end 418 of portion 408 is disposed against and inner wall 79 of lower portion 78 of slot 74. Tab portion 404 is configured to be disposed against surface 72. Slot 410 is configured to receive portion 52 (shown in FIG. 5A) of slatwall hook 40 between channels 422, 424 and connecting portion 412. Such that tab portion 50 of slatwall hook 40 is free to extend from portion 406 of housing 402 into the upper portion 76 of slot 74. With portion 52 of slatwall hook 40 disposed in slot 410 of device 400, a screw or other securing means is inserted through channels 422 and 424 to secure portion 52 of slatwall hook 40 within slot 410 between the screw or securing means and connecting portion 412. With portion 52 of slatwall hook 40 disposed within slot 410 and the screw or securing means disposed through channels 422, 424, slatwall hook 40 cannot be removed from device 400 and slatwall hook 40 cannot be tilted in a direction A (shown in FIG. 6A), therefore, slatwall hook 40 cannot be removed from slatwall 70. Slatwall hook 40 is prevented from being tilted in a direction A, because end 416 is in contact with inner wall 79 of the lower portion of slot 78 and end 414 is in contact with surface 72. Furthermore, slatwall hook 40 cannot be tilted in a direction opposite to direction A, because portion 54 of slatwall hook 40 is disposed against surface 72. In this way, device 400 is configured to be locked (via inserting portion 52 of slatwall hook 40 into slot 410 and inserting a screw or other securing means through channels 422, 424) to prevent slatwall hook 40 from being removed from slatwall 70.

Figure 8A:
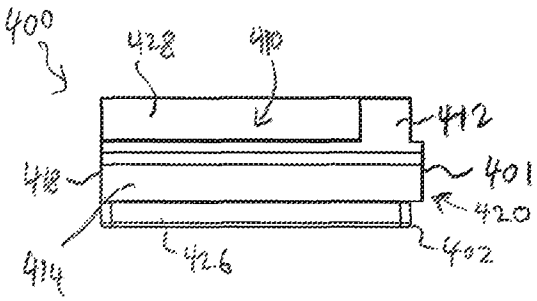
FIGS. 8A-8E and 8K include various views of an alternative embodiment of the locking device of FIG. 6A in accordance with the present disclosure.
Figure 8C:
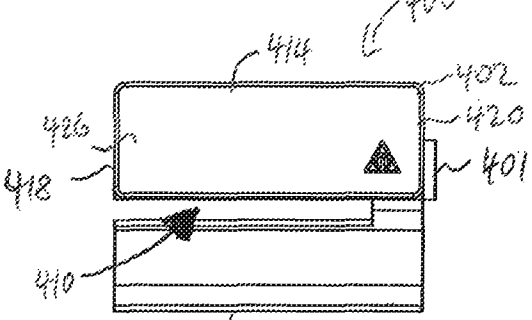
Figure 8D:
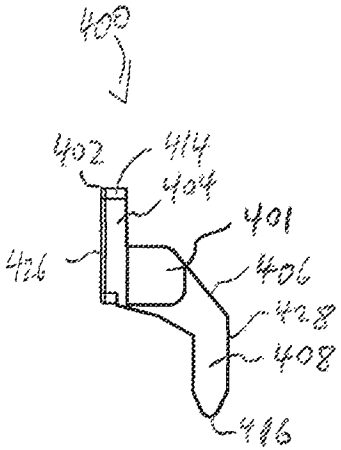
Figure 8B:
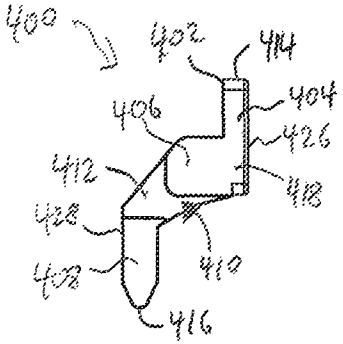
Figure 8E:
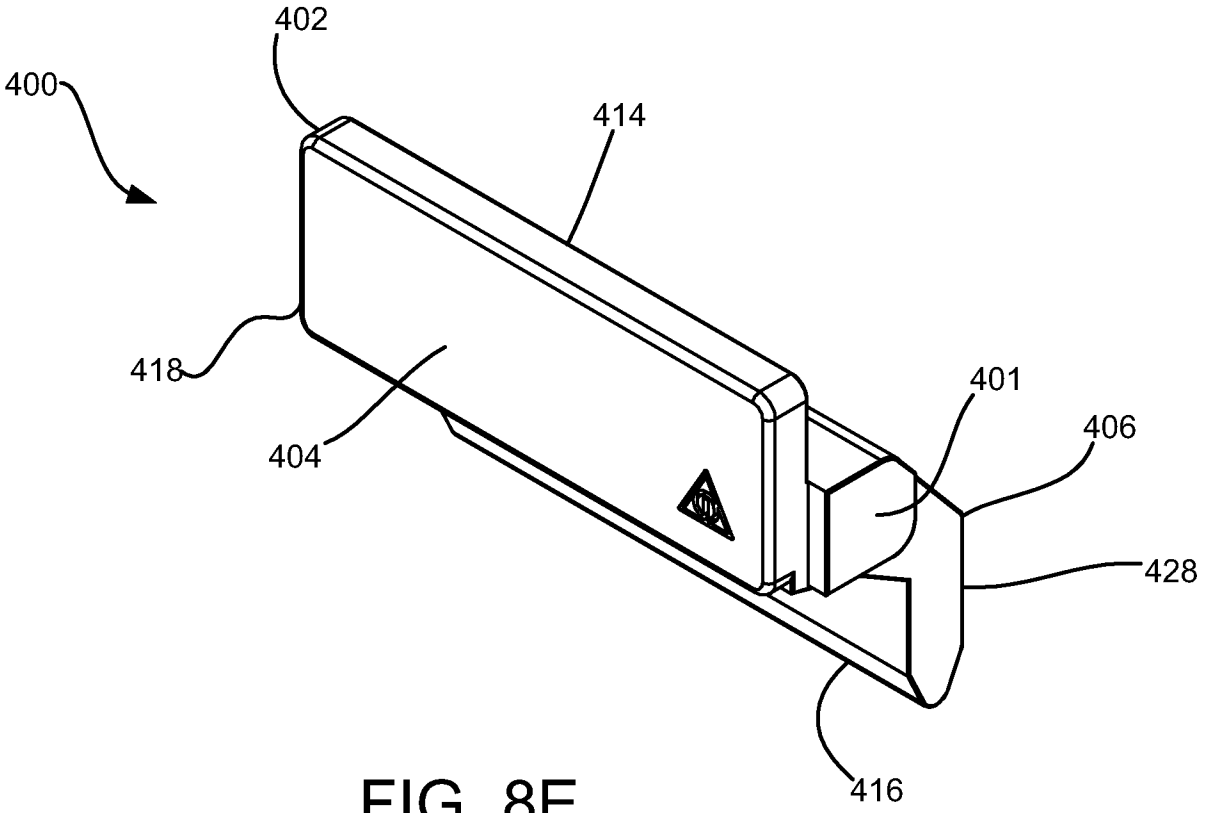
Figure 8F:
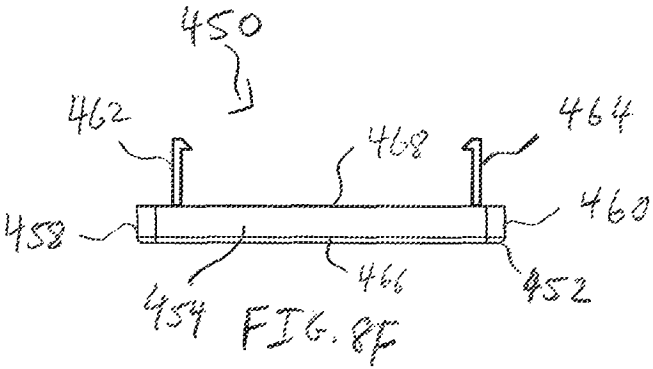
FIGS. 8F-8J includes various views of a clip of the locking device of FIGS. 8A-8E in accordance with an embodiment of the present disclosure.
Figure 8H:
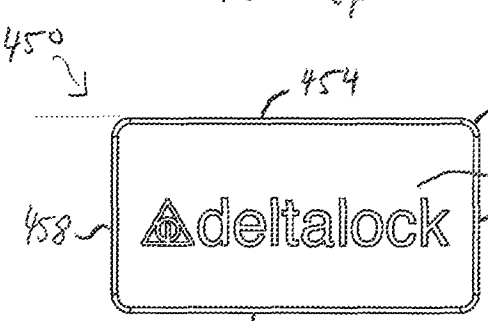
Figure 8I:
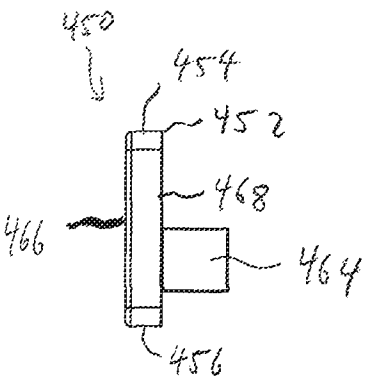
Figure 8G:
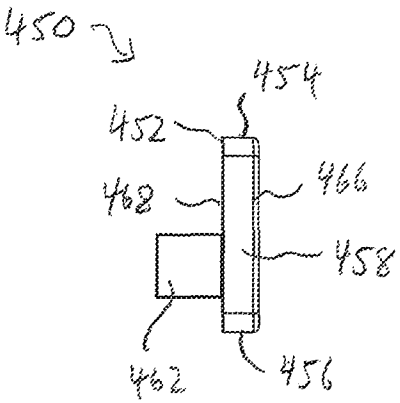
Figure 8J:
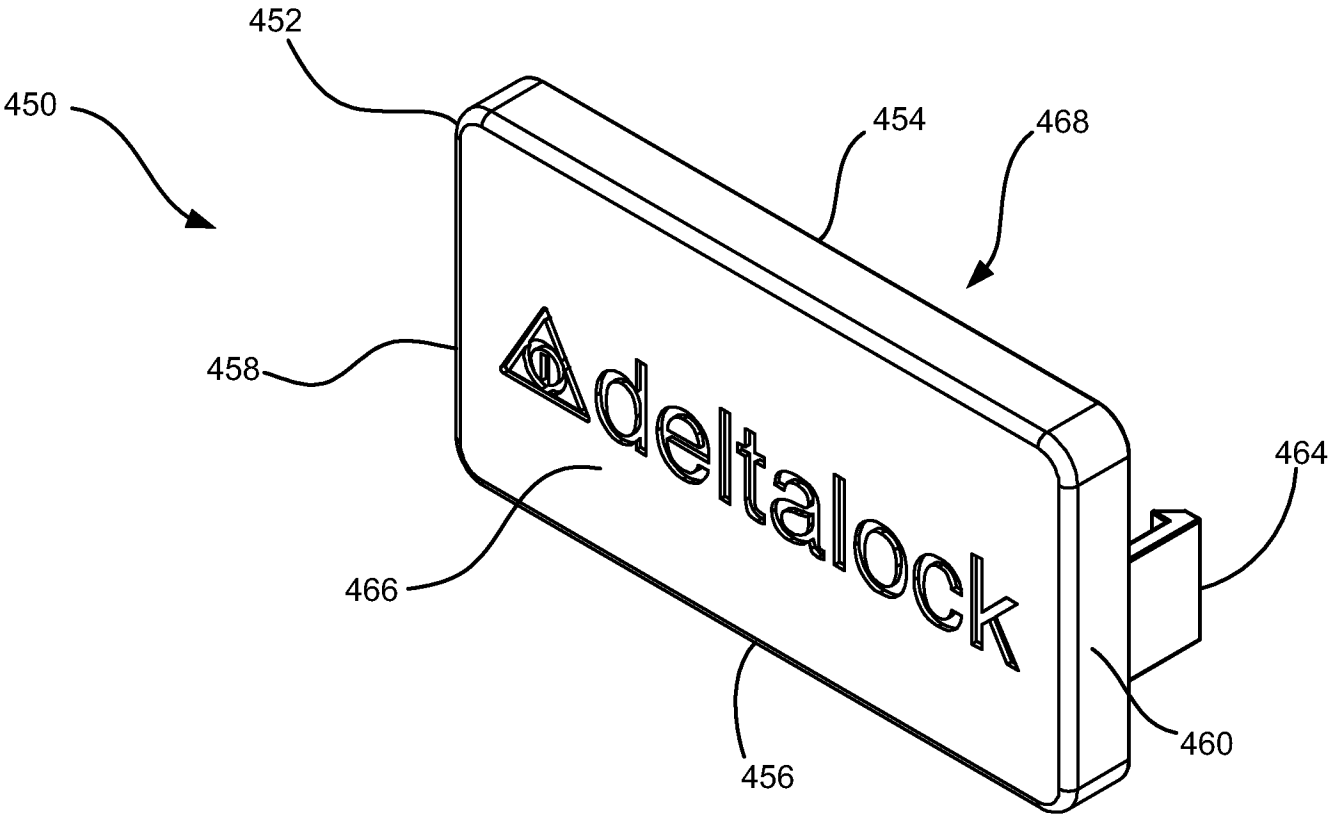

In another embodiment of the present disclosure, locking device 400 may be configured to secure a slatwall hook 40 to a slatwall 70 without using a screw or other securing means disposed through channels 422, 424. For example, referring to FIGS. 8A-8E, another embodiment of locking device 400 is shown in accordance with the present disclosure. In this embodiment, channels 422, 424 are removed from housing 402 and housing 402 further includes an extension member 401. Extension member 401 extends or projections away from bridging or connection portion 412 of portion 406 (as best seen in FIGS. 8A, 8C, and 8D).

Referring to FIGS. 8D-8J, in this embodiment, locking device 400 further includes a clip 450, which is configured to be coupled to portion 406 of housing 402, as will be described in greater detail below. Clip 450 includes a clip housing having opposite ends 454, 456, opposite sides 458, 460, and opposite sides 466, 468. Clips 450 further includes securing members 462, 464, which are coupled to and extend from a planar surface of side 468. Securing member 462 is disposed more proximately to side 458 of housing 452 than side 460 and securing member 464 is disposed more proximately to side 460 of housing 452 than side 458.

Figure 8K:
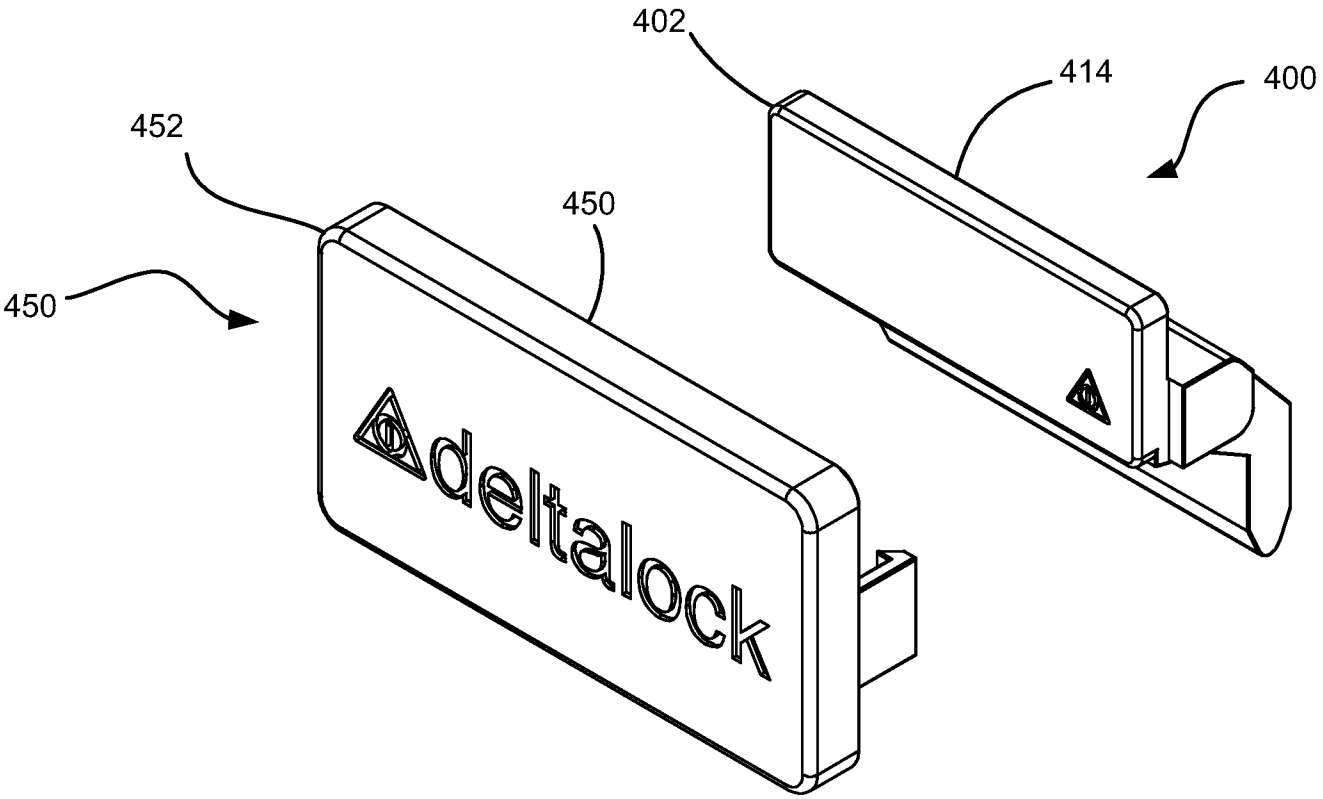
Figure 8L:
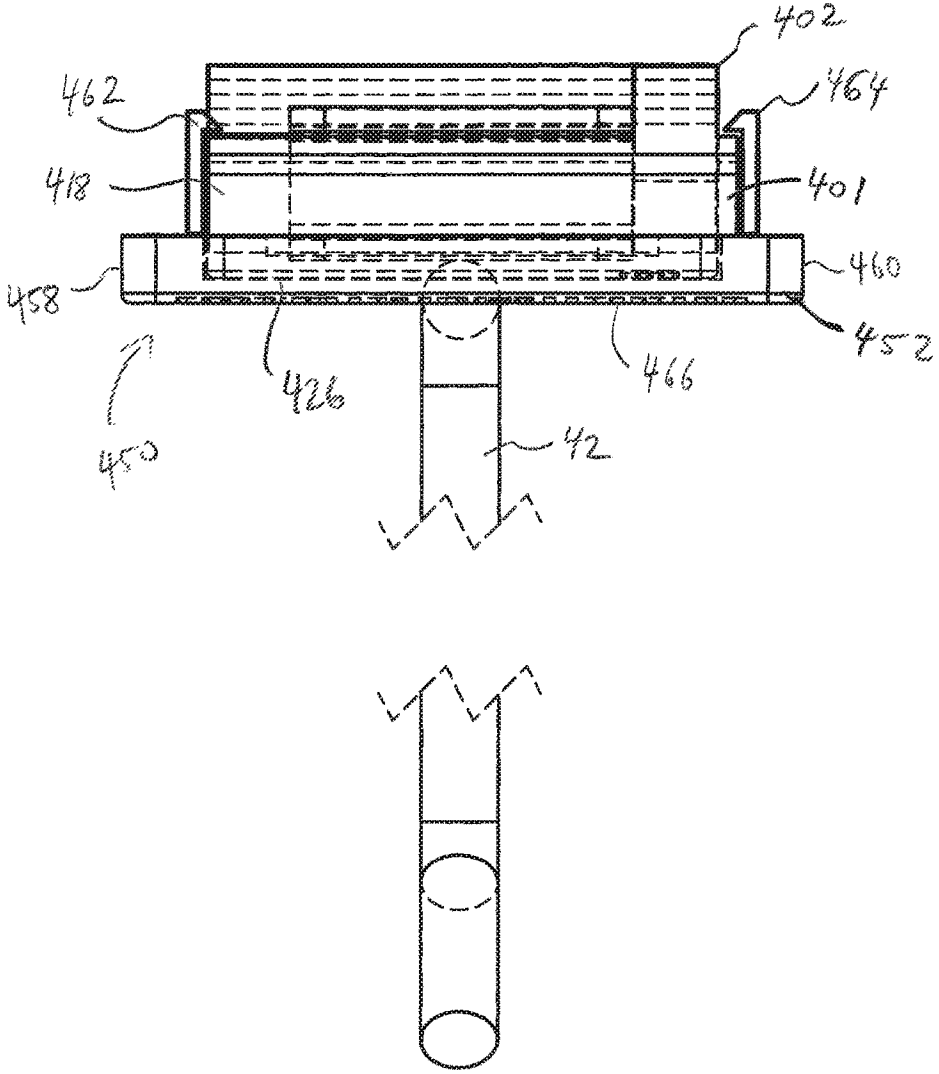
Figure 8N:
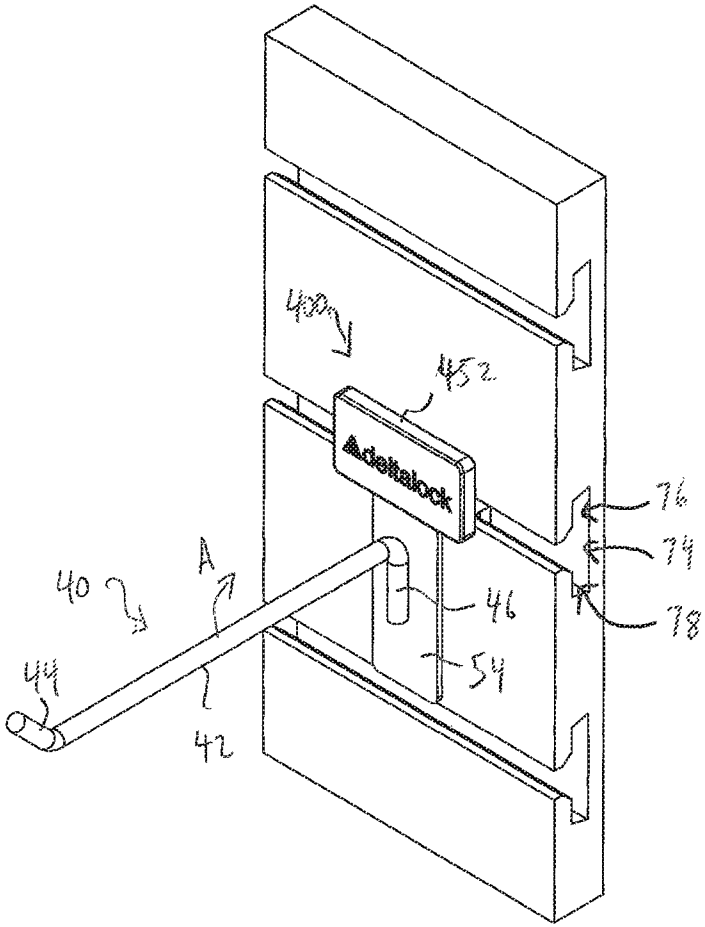
Figure 8M:
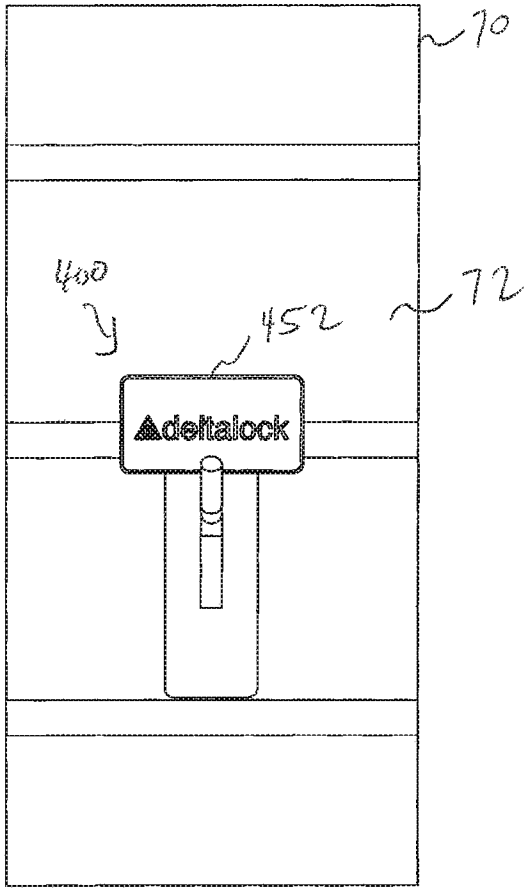
Figure 80:
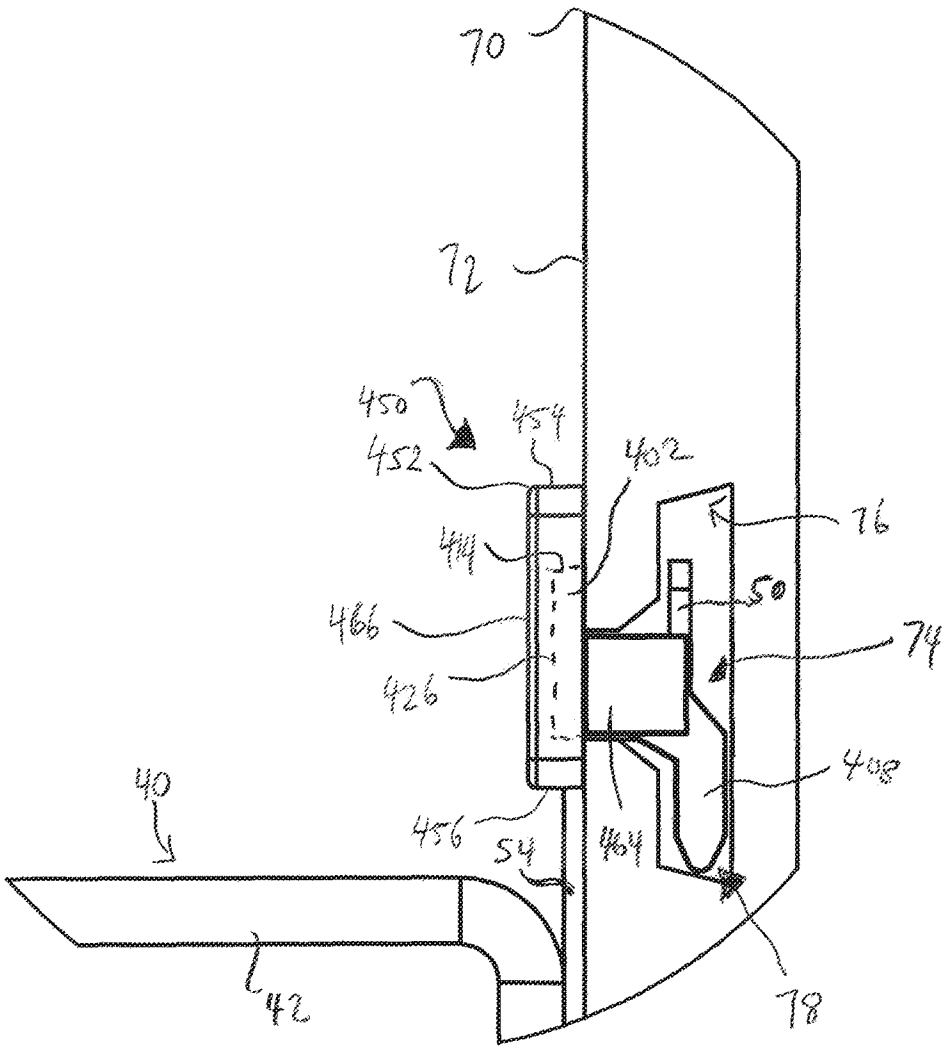

Referring to FIGS. 8K and 8L, clip 450 is configured to be coupled to portion 406 of housing 402. As best seen in FIG. 8L, to couple clip 450 to portion 406 of housing 402, securing member 462 is configured to be secured to or engage side 418 of portion 406 and securing member 464 is configured to be secured to or engage extension member 401 of portion 406. Referring to FIGS. 8L, 8M, 8N, and 8O, clip 450 and housing 402 are coupled together and device 400 is shown securing a slatwall hook 40 to slat wall 70. As best seen in FIGS. 8L and 8O, clip 450 is configured such that, when clip 450 is coupled to portion 406 of housing 402, end 454 of clip housing 452 extends past end 414 of housing 402, side 458 of clip 450 extends past side 418 of housing 402 and side 460 of clip 450 extends past side 420 of housing 402. In this way, sides 466, 468 of clip 450 have a larger surface area with respect to side 426 of device 400, which enables the planar surface of side 468 to contact the planar surface 72 of board 70 both above and below slot 74. The increased surface area of sides 466, 468 make it more difficult to create twisting leverages and rotational torques on device 400, thus making it more difficult to remove device 400 from slatwall 70. Furthermore, the increased surface area of sides 466, 468 and engaging members 462, 464 of clip 450 decrease the visibility and access to device 400 when device 400 is coupled to slatwall 70. The decreased visibility and access to device 400 makes it more difficult for a user to both assess how to remove device 400 and interact with device 400.

Figure 7A:
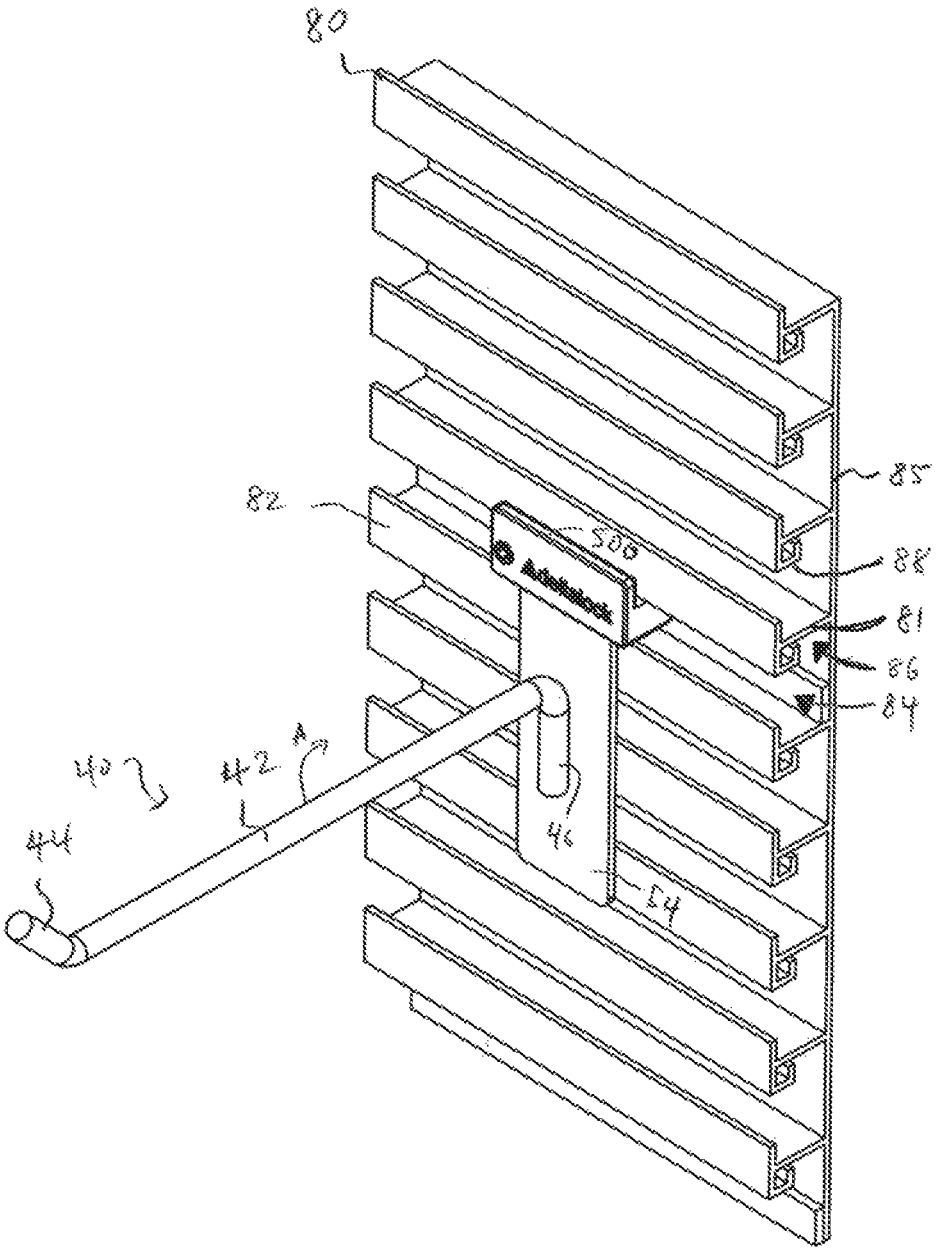
FIG. 7A is a perspective view of an alternative locking device securing a slatwall hook to an alternative slatwall in accordance with an embodiment of the present disclosure.
Figure 7B:
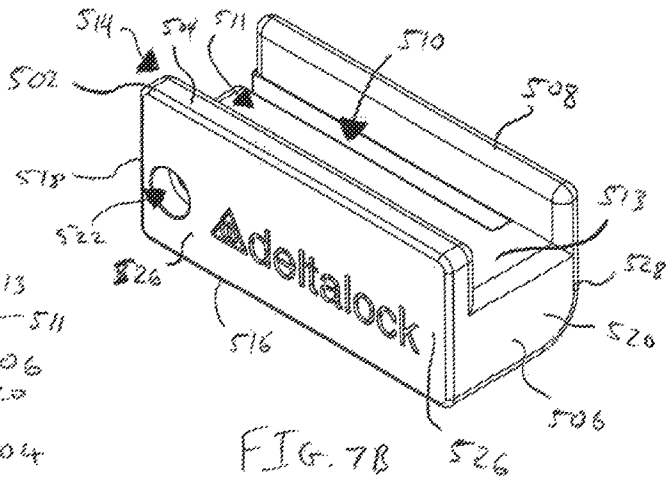
FIGS. 7B-7G include various view of the locking device of FIG. 7A in accordance with an embodiment of the present disclosure.
Figure 7G:
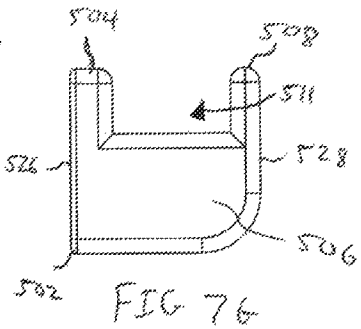
Figure 7C:
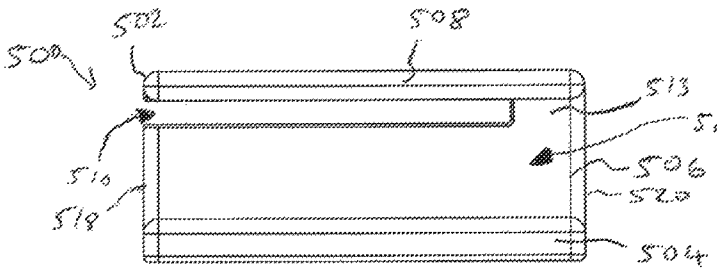
Figure 7D:
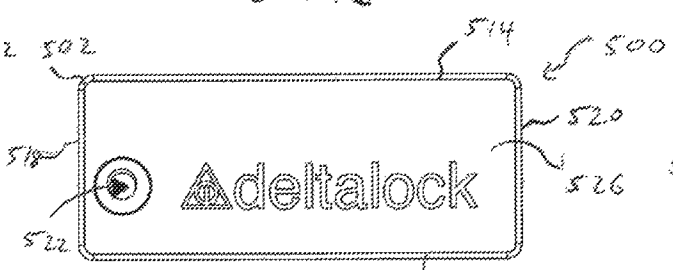
Figure 7E:
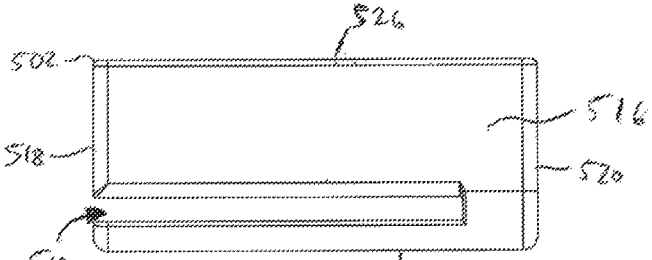
Figure 7F:
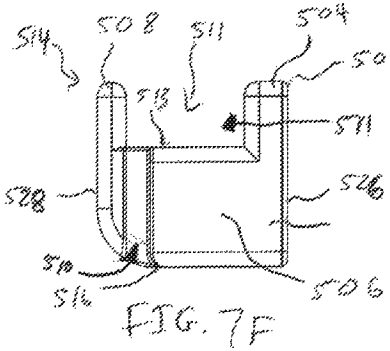

Referring to FIG. 7A, an alternative slatwall 80 is shown in accordance with the present disclosure. Slatwall 80 includes a backing or support sheet 85 and portions 81, 82, 88. Portions 81 are configured as extension members extending from backing or support sheet 85. Each portion 81 is coupled to a portion 82. Each portion 82 is configured as a substantially planar, where each surface 82 is aligned perpendicular to the portion 81 it is coupled. Each surface 82 is further coupled to portion 88. Portions 81, 82, 88 each define a slot 84, where each slot 84 includes an upper portion 86. Slatwall hooks 40 are coupled to slatwall 80 by tilting rode 42 in a direction A and inserting tab 50 into upper portion 86 of slot 84, such that tab 54 is disposed against one or more surfaces 82 of slatwall 80.

The present disclosure provides a locking device 500 configured to secure slatwall hooks 40 to slatwall 80 configured as shown in FIG. 7A. Referring to FIGS. 7B-7G, a plurality of view of locking device 500 are shown in accordance with the present disclosure. Locking device 500 includes a housing 502 having opposite sides 518, 520, opposite sides 526, 528, and opposite ends 514, 516. Housing 502 includes a base 506 and tab or extension members 504, 506, which extend from base 506 in a direction toward end 514 of housing 502. Base 506 includes a surface 513, where tabs 504, 508 and surface 513 device a slot 511. Base 506 further includes a slot 510 extending from side 518 toward side 520 of housing 502. It is to be appreciated that slot 510 terminates before reaching side 520 of housing 502. Base 506 also includes a channel 522 extending from side 526 toward side 528 of housing 502. It is to be appreciated that channel 522 traverses a portion of slot 510 disposed proximately to side 518 of housing 502.

Figure 7H:
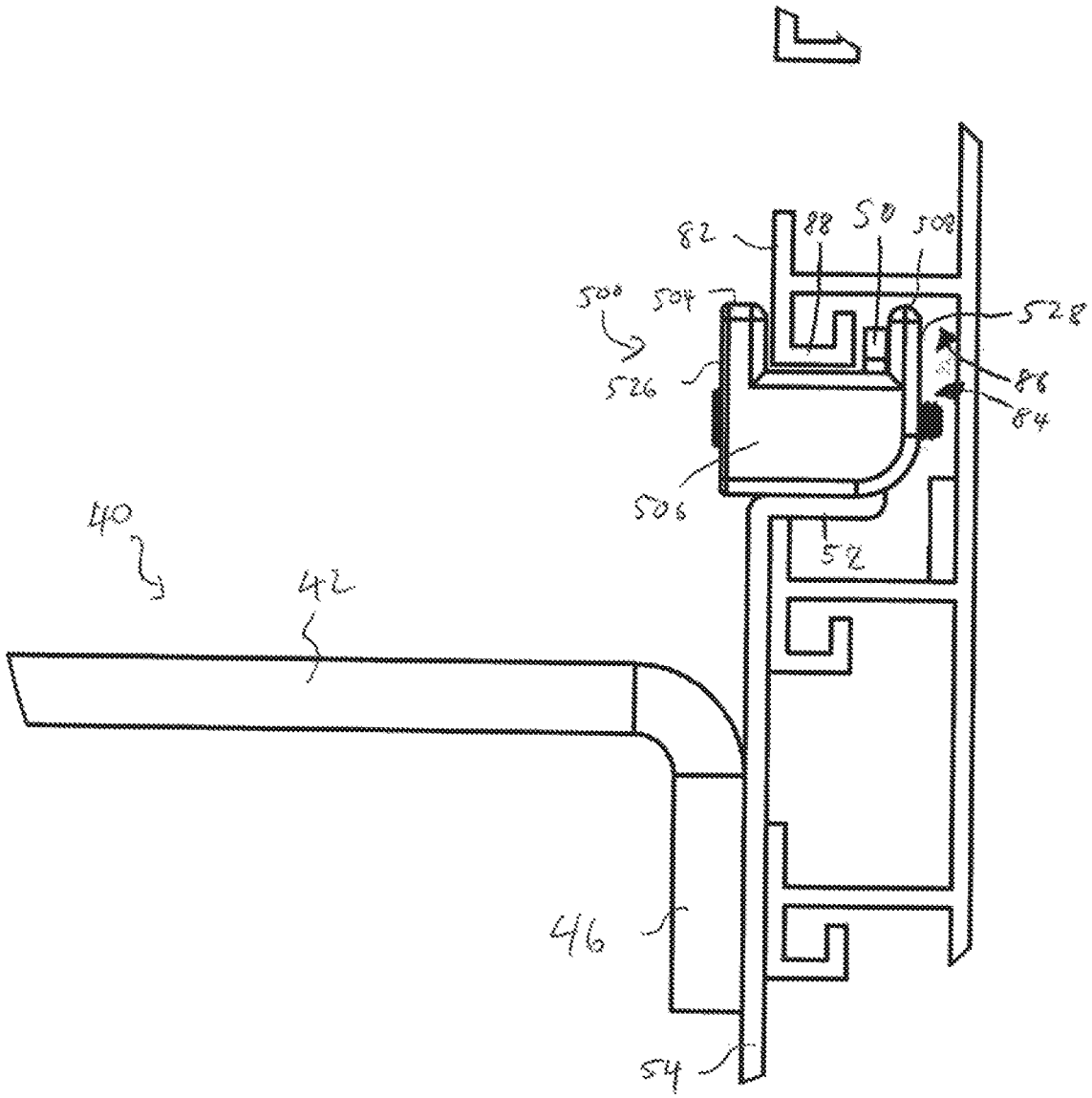
FIG. 7H is a side view of the locking device of FIG. 7A securing a slatwall hook to the alternative slatwall of FIG. 7A in accordance with an embodiment of the present disclosure.

Referring to FIGS. 7A and 7H, in use, while slatwall hook 40 is coupled to slatwall 80, tab 508 of device 500 is inserted into upper portion 86 of slot 84 such that portion 88 of slatwall 80 is disposed in slot 511 between tabs 508 and tab 504. Tab 504 is disposed against surface 82. Slot 510 is configured to receive tab 50 of slatwall hook 40 between the portion of slot 510 that channel 522 traverses and the end of slot 522 disposed proximately to side 520 of housing 502 such that tab 50 is disposed against tab 508. Portion 502 is disposed against end 516 of housing 502. While tab 50 is disposed through slot 510, a screw or other securing means is inserted through channel 522 to tab 50 in slot 510.

With tab 50 of slatwall hook 40 disposed through slot 510 and the screw or securing means disposed through channel 422, slatwall hook 40 cannot be removed from device 500 and slatwall hook 40 cannot be tilted in a direction A (shown in FIG. 7A), therefore, slatwall hook 40 cannot be removed from slatwall 80. Slatwall hook 40 is prevented from being tilted in a direction A, because tab 514 disposed against surface 82 of slatwall hook 40. Furthermore, slatwall hook 40 cannot be tilted in a direction opposite to direction A, because tabs 50 and 508 are disposed against portion 88 of slatwall 80. In this way, device 500 is configured to be locked (via inserting tab 50 of slatwall hook 40 into slot 510 and inserting a screw or other securing means through channel 522) to prevent slatwall hook 40 from being removed from slatwall 80.

It is to be appreciated that each of locks 400, 500 while in a locked state and securing hooks 40, are configured to enable the hooks 40 that they secure to slide in a horizontal direction along the slots 74, 84 that the hooks 40 are disposed in while also preventing hooks 40 from being removed from slatwalls 70, 80.

Figure 10A:
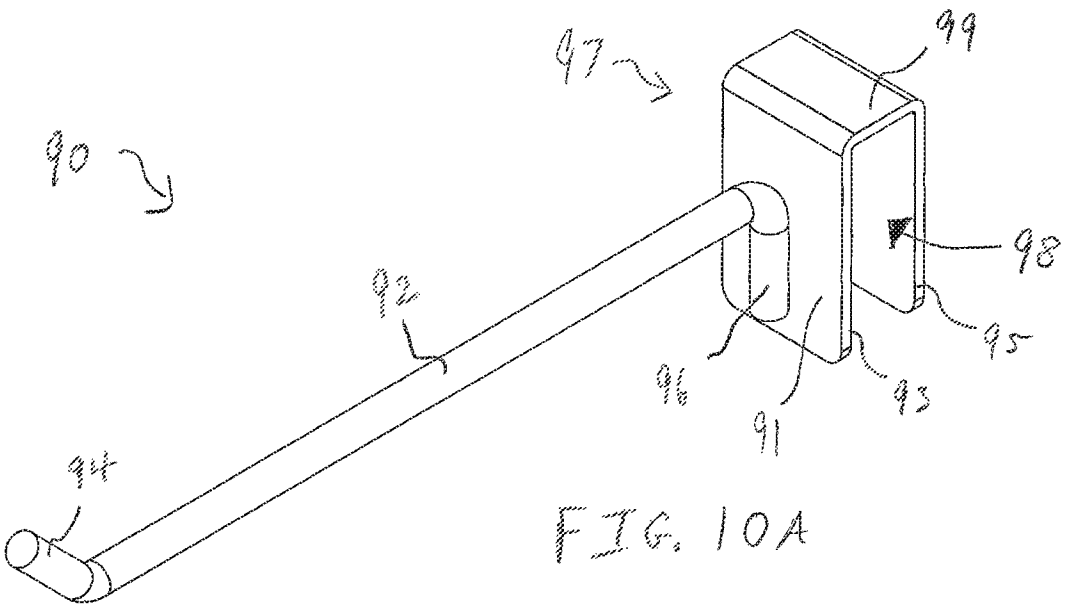
FIGS. 10A and 10B include various views of a crossbar hook in accordance with an embodiment of the present disclosure.
Figure 10B:
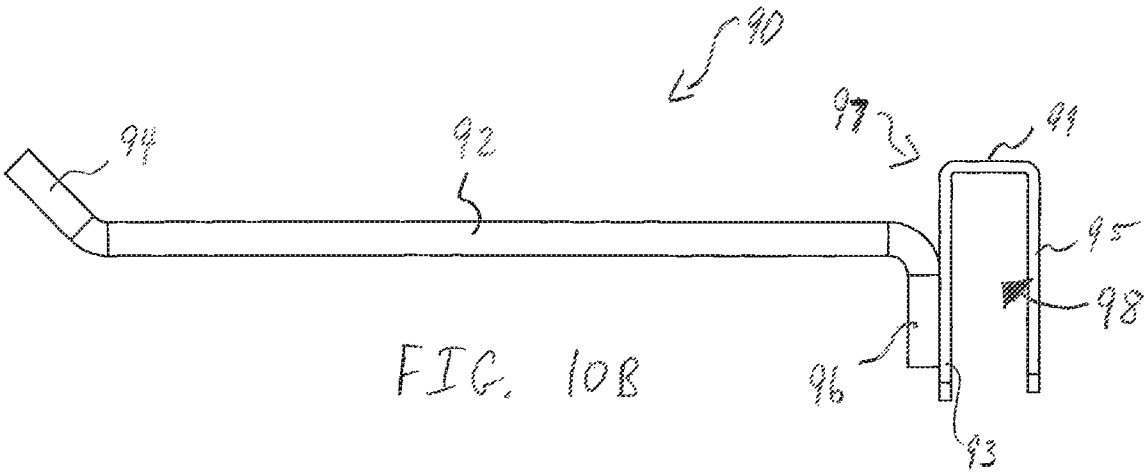

Referring to FIGS. 10A and 10B, crossbar hook 90 is shown in accordance with the present disclosure. Crossbar hook 90 includes a rod or wire 92 having bent ends 94 and 96. Bent ends 94, 96 are bent in opposite directions with respect to the linear central portion of rod 92, where end 96 is bent in a substantially perpendicular manner with respect to the linear portion of rod 92. Hook 90 further includes a base 97 having portions 93, 95, 99, where portions 93, 95, 99 are each formed as substantially planar tabs. Tabs 93, 95 are oriented in a substantially parallel manner and are separated by tab 99, which is oriented in a substantially perpendicular manner to tabs 93, 95. Between tabs 93, 95, slot 98 is formed. Bent end 96 is coupled to a surface 91 of tab 93.

Figure 10C:
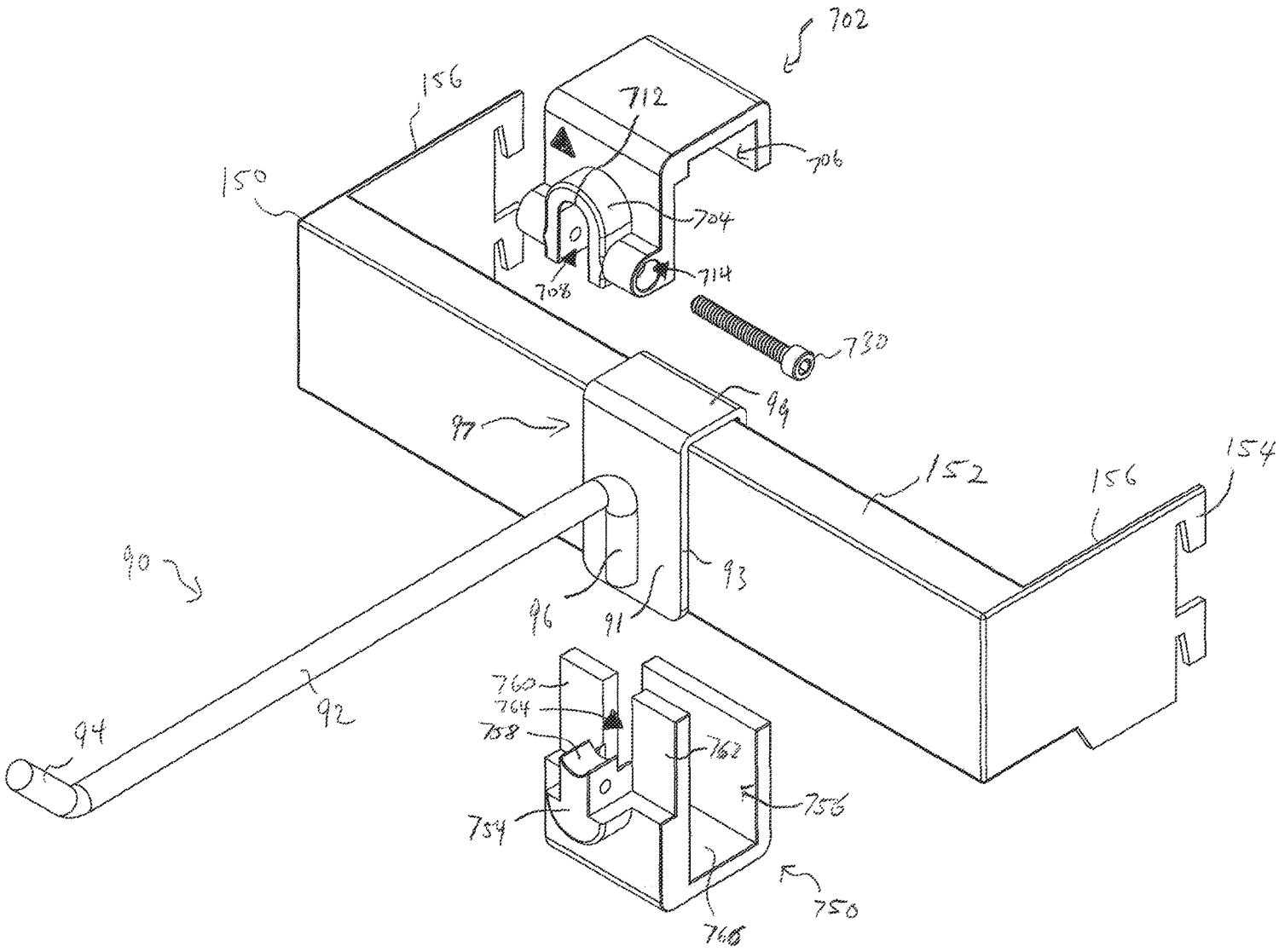
FIGS. 10C-10D include perspective views of a locking device for securing a crossbar hook to a crossbar in accordance with an embodiment of the present disclosure.

Referring to FIG. 10C, hook 90 is shown coupled to a crossbar 150 in accordance with the present disclosure. Crossbar 150 includes a bar 152 and legs 156. Bar 152 is coupled between legs 156, where legs 156 extends from bar 152. Each of legs 156 includes one or more tabs 154 for mounting crossbar 150 to a slatwall or pegboard. Hook 90 is coupled crossbar 152 by placing hook 90 over crossbar 152 such that bar 152 is inserted into slot 98 of base 97.

Figure 10D:
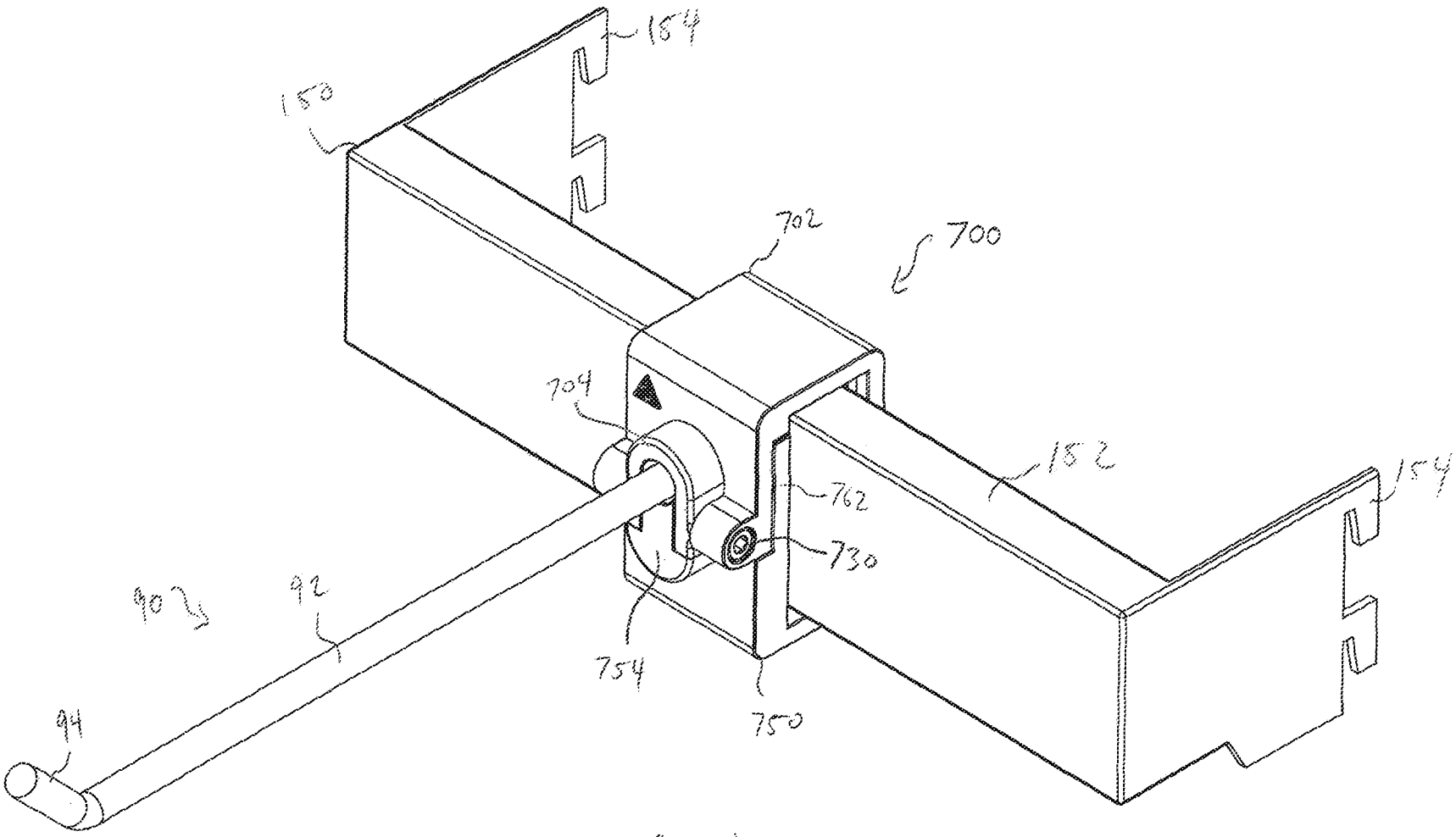
Figure 10J:
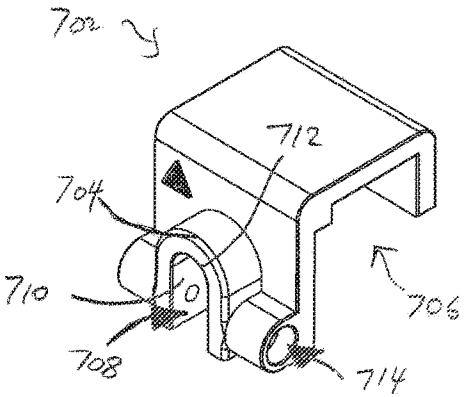
FIGS. 10E-10J include various views of an upper housing of the locking device of FIGS. 10C-10D in accordance with an embodiment of the present disclosure.
Figure 10H:
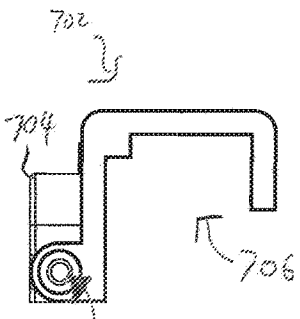
Figure 10E:
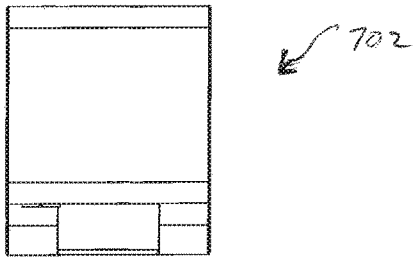
Figure 10G:
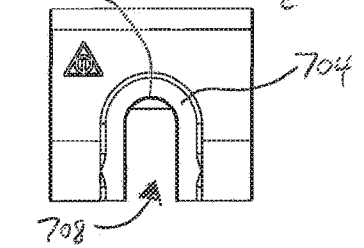
Figure 10I:
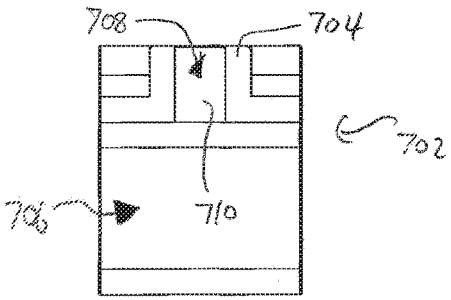
Figure 10F:
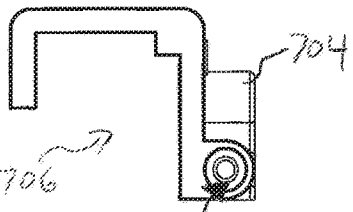
Figure 10P:
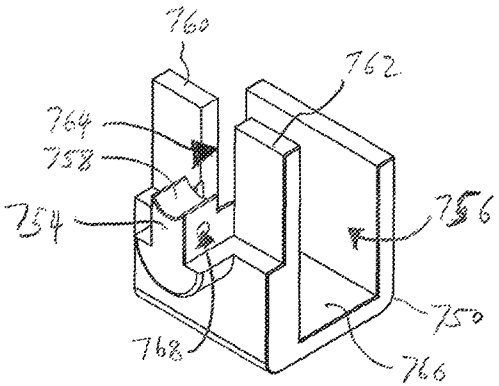
FIGS. 10K-10P include various views of a lower housing of the locking device of FIGS. 10C-10D in accordance with an embodiment of the present disclosure.
Figure 10N:
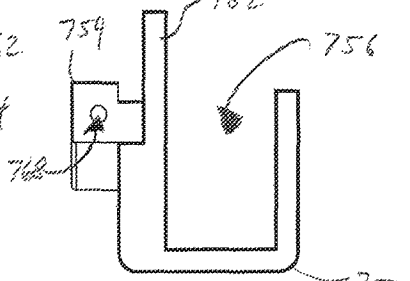
Figure 10K:
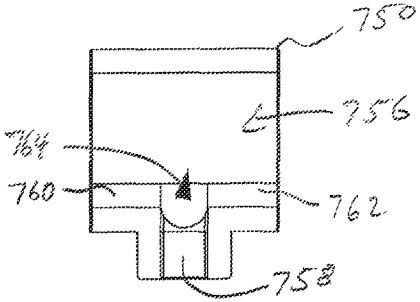
Figure 10M:
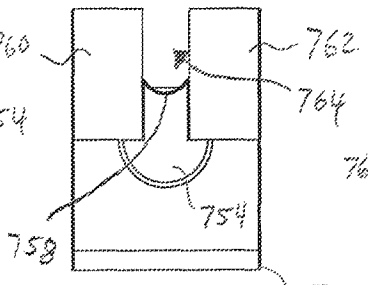
Figure 10O:
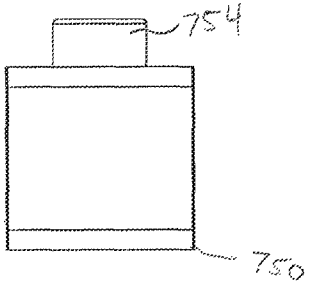
Figure 10L:
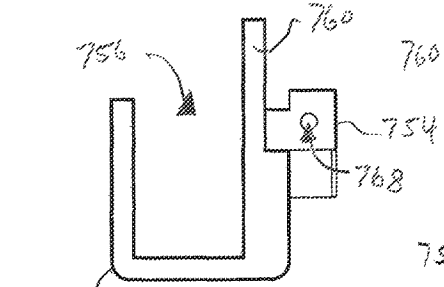

Referring to FIGS. 10C and 10D, in another embodiment of the present disclosure, a locking device 700 is provided for securing a crossbar hook 90 to a crossbar 150. Locking device 700 includes an upper housing 702 and a lower housing 750. Referring to FIGS. 10E-10J, upper housing 702 is shown in various views in accordance with the present disclosure. Housing 702 is configured in a substantially u-shaped manner defining an interior 706. Housing 702 includes a retention member 704, which extends from an exterior surface of housing 702. Retention member 704 includes a slot 708 defined by an inner wall 710 of retention member 704. Slot 708 provides access to interior 706 of housing 702. An upper portion 712 of inner wall 710 is configured in a concave shape. Member 704 includes channels 714, 716, which are disposed through opposite sides of member 704 and are coaxially aligned.

Referring to FIGS. 10K-10P, lower housing 750 is shown in various views in accordance with the present disclosure. Housing 750 is configured in a substantially u-shaped manner defining an interior 756. Housing 750 includes a retention member 754 and extension members 760, 762, where retention member 754 extends from an exterior surface of housing 750. A concave slot 764 is disposed between extension members 760, 762 and extends toward an interior surface 766 of housing 750. Retention member 754 includes a concave surface 758. A channel 768 extends from a first side of retention member 754 to a second side of retention member 754.

Figure 10Q:
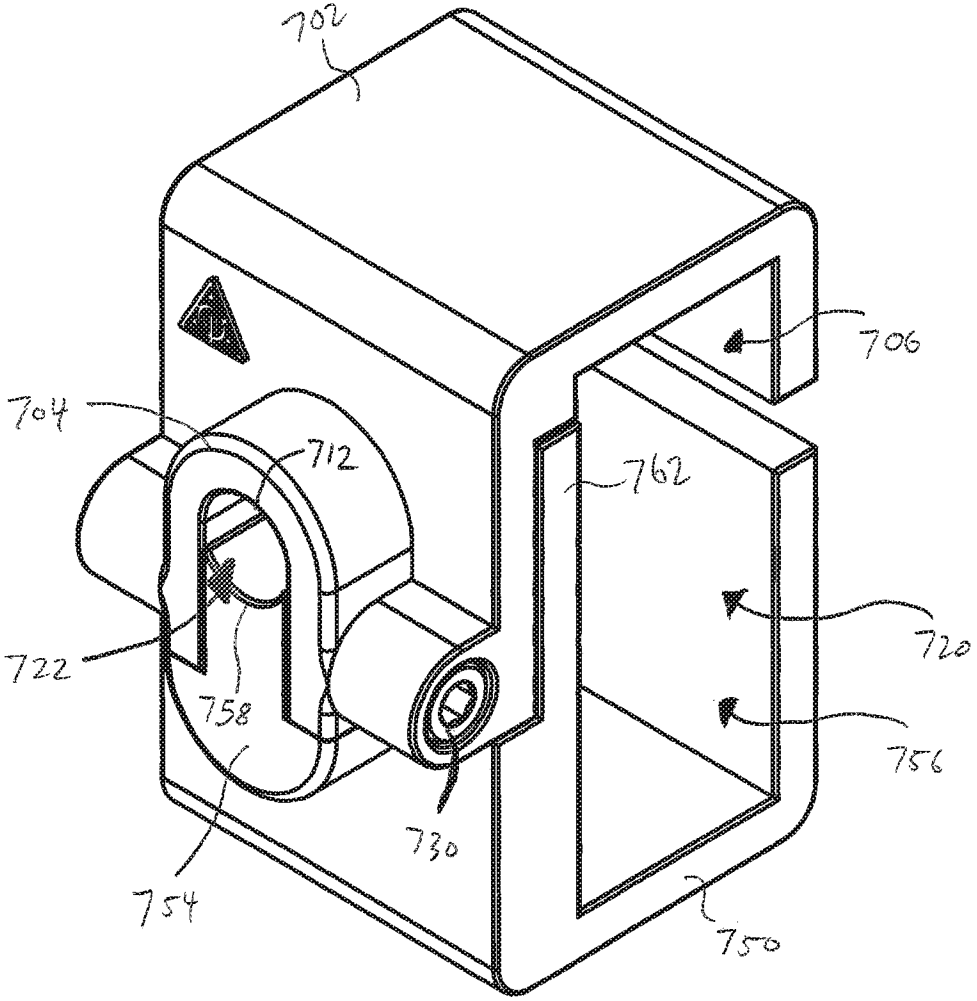
FIG. 10Q is a perspective view of the locking device of FIGS. 10C-10D in accordance with an embodiment of the present disclosure.

Referring to FIG. 10Q, housing 702 is shown coupled to housing 750. When housings 702 and 750 are coupled, a joint interior slot 720 is formed by interiors 706 and 756. Furthermore, a portion of retention member 754 extends into a portion of slot 708 and a circular channel 722 having substantially the same diameter as rod 92 is formed by concave inners surfaces 712, 758. Also, extension members 760, 762 extend into interior 706 of upper housing 702, such that members 760, 762 are disposed adjacent to an inner surface of interior 706 to provide support and rigidity to device 700 when housing 702 is coupled to housing 750. With the portion of retention member 754 disposed in slot 708, channels 714, 768, and 716 coaxially align and a securing member (such as a screw) 730 is disposed through channels 714, 768, 716 to secure upper housing 702 to lower housing 750 such that crossbar hook 90 cannot be removed from crossbar 150.

Referring again to FIGS. 10C and 10D, in use, while hook 90 is coupled to bar 152, upper housing 702 and lower housing 750 are disposed over base 97 of hook 90 and bar 152 of crossbar 150, such that base 97 and a portion of bar 152 are disposed in joint interior 720 of device 700. In this position, a portion of rod 92 is disposed through joint slot 722 (shown in FIG. 10Q) of device 700 and bent end 96 of hook 90 extends into slot 764 toward interior surface 766. It is to be appreciated that because slot 764 receives bent end 96, inner surface 761 of lower housing 750 is enabled to come in closer proximity with surface 91 of base 97 than would otherwise be allowable, such that device 700 is more securely coupled to hook 90 and bar 152. To lock locking device 700, securing means 730 is inserted through channels 714, 768, 716 to prevent hook 90 from being removed from bar 152.

Figures 11A, 11B, 11C:
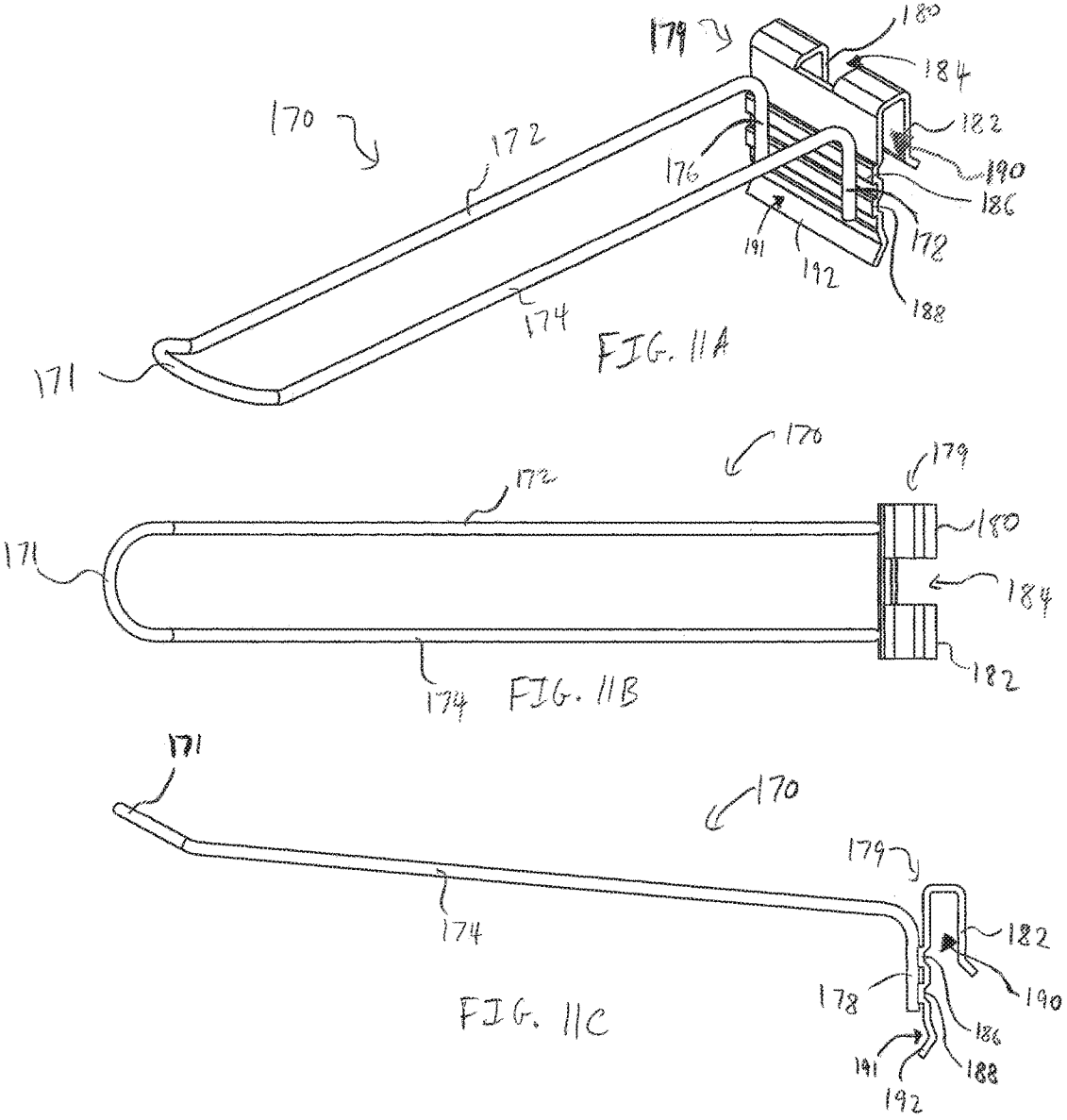
FIGS. 11A-11C include various views of an alternative crossbar hook in accordance with an embodiment of the present disclosure.
Figure 11D:
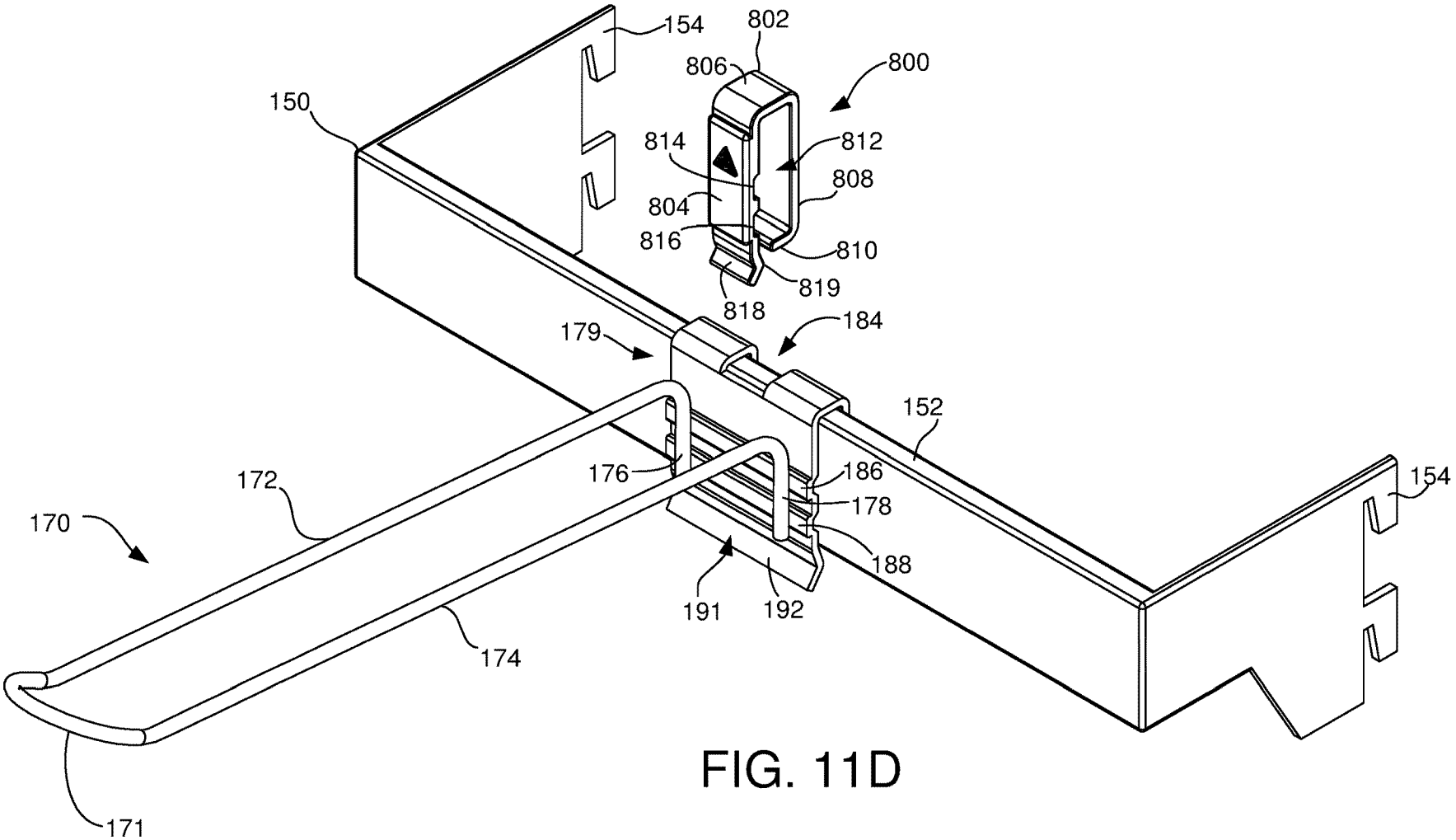
FIGS. 11D-11K include various views of a locking device for securing the alternative crossbar hook of FIGS. 11A-11C to a crossbar in accordance with an embodiment of the present disclosure.

Referring to FIGS. 11A-11C, an alternative crossbar hook 170 including a loop is shown in accordance with the present disclosure. Hook 170 includes rods or wires 172 and base 179, where rod 172 includes a bent end 176, rod 174 includes a bent end 178, and rods 172, 174 share a bent end 171. Bent end 171 is configured as a loop and bent ends 176, 178 are coupled to base 179. Base 179 includes protrusions 186, 188, bent end 192, a slot 190, a gap 184, and legs or mounting members 180, 182. Gap 184 is disposed between legs 180, 182. Bent end 192 defines a recess 191. Referring to FIG. 11D, to mount hook 170 to crossbar 150, bar 152 is received in slot 190.

Figure 11E:
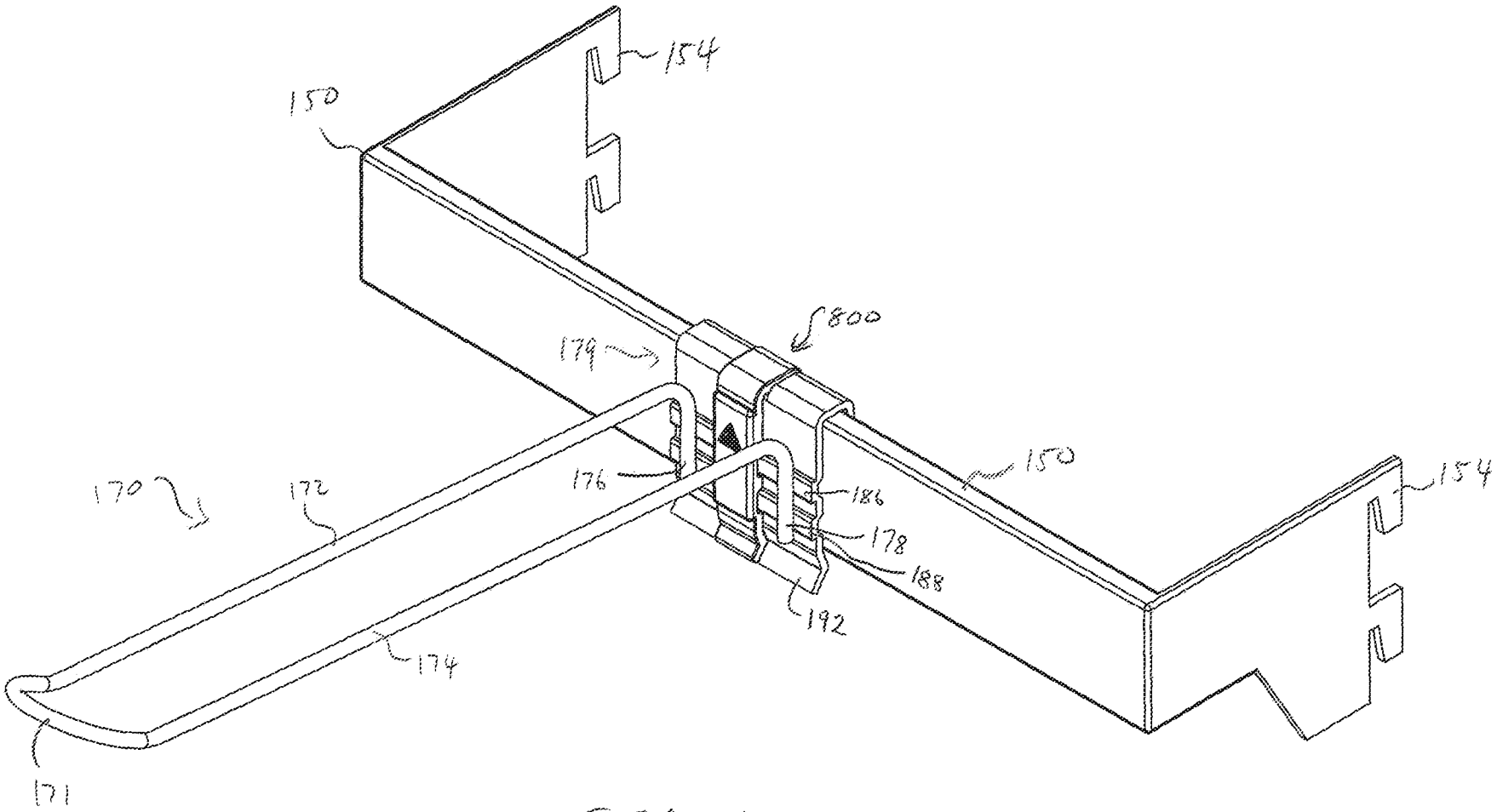
Figure 11H:
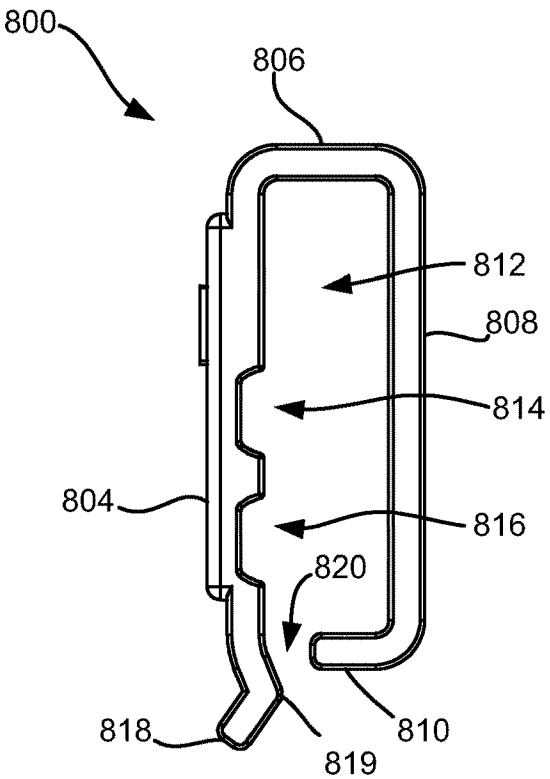
Figure 11G:
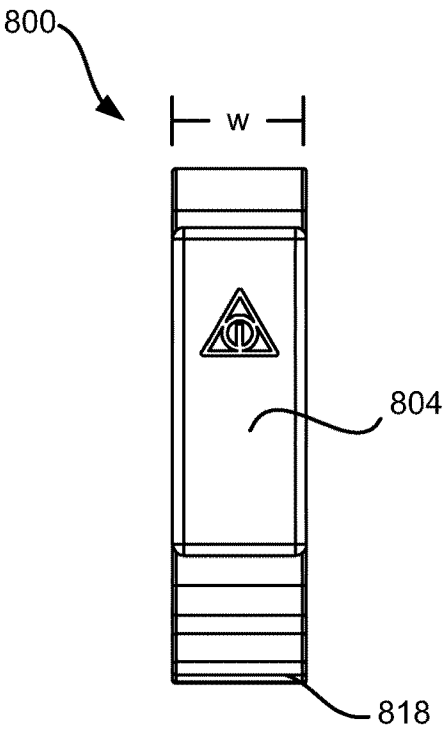
Figure 11F:
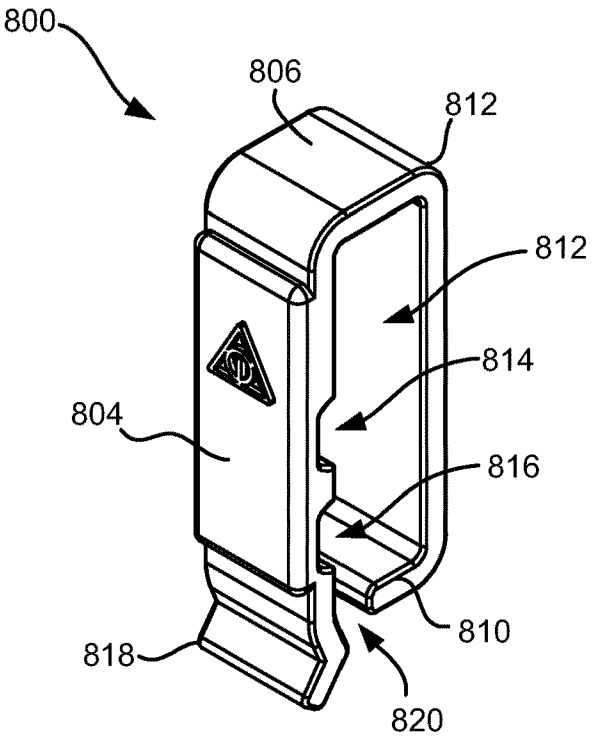

Referring to FIGS. 11D-11E, a locking device 800 for securing hook 170 to bar 152 and preventing hook 170 from being removed from bar 152 is shown in accordance with the present disclosure. Referring to FIGS. 11F-11H, various views of locking device 800 are shown in accordance with the present disclosure. Locking device 800 includes a clip housing 802 having a front portion 804, a top portion 806, a back portion 808, and a bottom portion 810. A first end 818 of portion 804 is bent in a similar manner to bent end 192 of base 179. Bent end 818 includes protrusion 819 configured to match the shape of recess 191 in base 179. The inner surfaces of portion 804, 806, 808, 810 define and interior or slot 812. The inner surface of portion 808 includes slots or recesses 814, 816, which are configured to receive protrusions 186, 188 of base 179. A gap or open end 820 is included between the first and second ends of housing 802 (i.e., between an end of portion 810 and bent end 818 of portion 804). As shown in FIG. 11G, housing 802 has a width w, which is substantially equal to (or slightly less) than the width of gap 184 of base 179 of hook 170. In this way, portions 806, 808 of housing 802 is configured to fit within gap 184. It is to be appreciated that clip housing 802 is configured to be sufficiently flexible to enable end 818 of portion 804 to be pulled away or separated from the end of portion 810 to increase the distance between portions 804 and portions 808, 810 thereby increasing the width of gap 820 and enabling the base 179 of hook 170 and a portion of bar 152 to be received by the interior 812 of device 800.

Figure 11I:
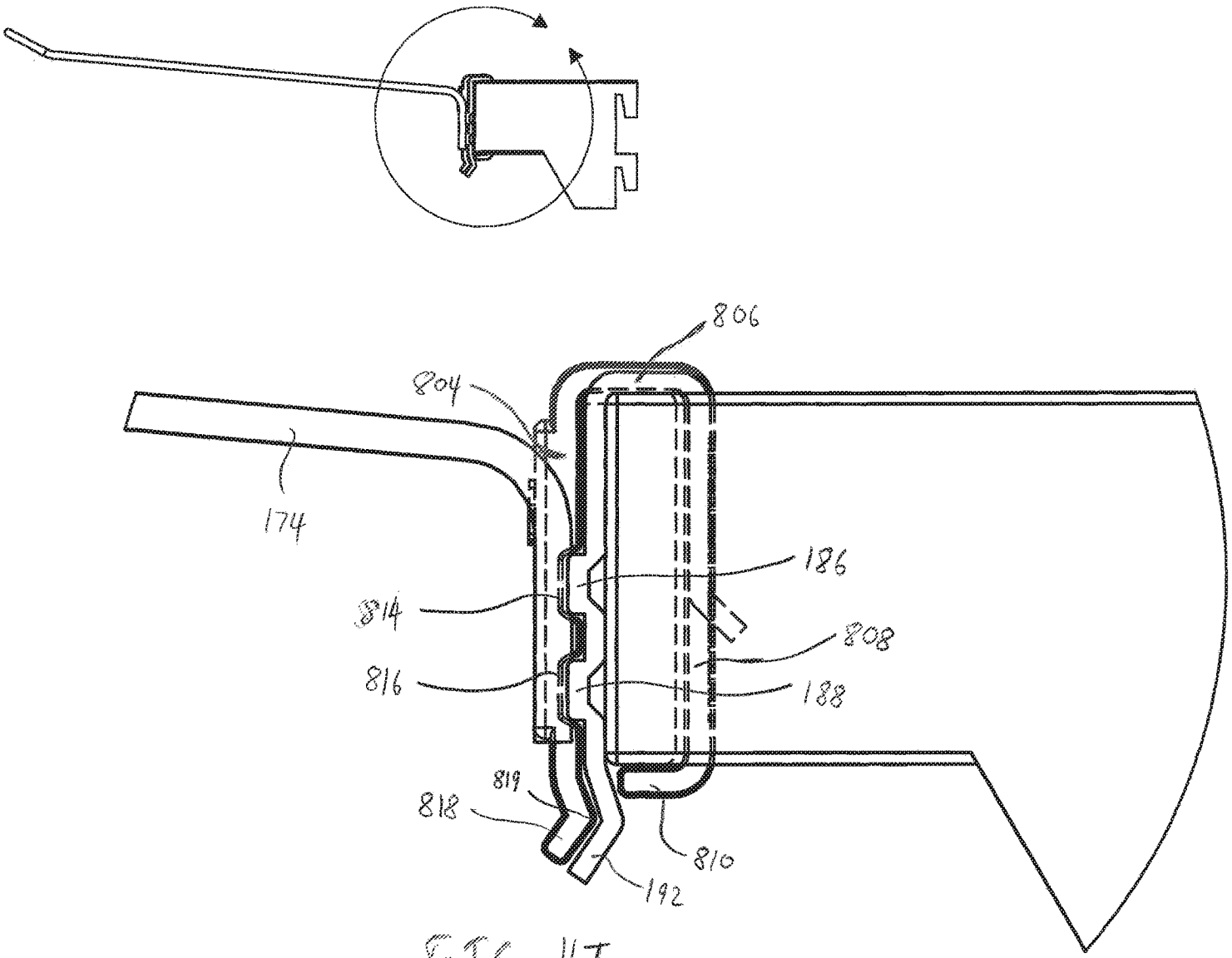
Figure 11L:
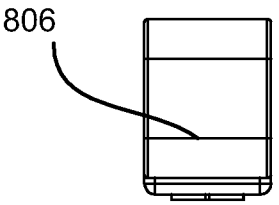
Figure 11K:
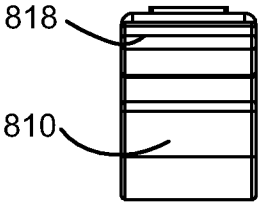
Figure 11J:
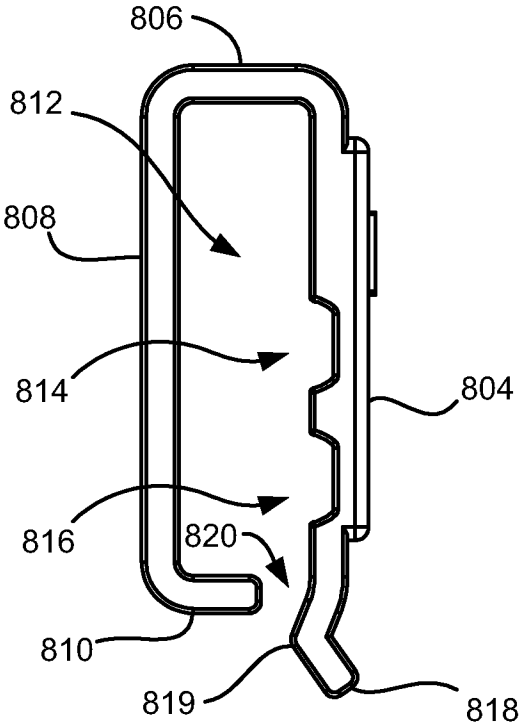

Referring to FIGS. 11D, 11E, and 11I, in use, while hook 170 is mounted to crossbar 150, portion 804 and portions 808, 810 are pulled away from each other to enable clip housing 802 to be disposed around base 179 of hook 170 and bar 152 of crossbar 150 via gap 820. In this position, bar 152 is disposed in interior 812 of housing 802 and surrounded by the interior surfaces of portions 804, 806, 808, 810. When device 800 is coupled to base 179 and bar 152, portions 806 and 808 of housing 802 are received by slot 184, protrusions 186, 188 are received by slots 814, 816, respectively, and bent end 818 is disposed adjacent to bent end 192 such that protrusion 819 extends into recess 191. While clip housing 802 is disposed around base 179 and bar 152, portion 810 prevents hook 170 from being removed from bar 152. It is to be appreciated that because slots 814, 816 are configured to receive protrusions 186, 188 and bent end 818 is configured in substantially the same manner as bent end 192, housing 802 is configured to fit as securely as possible around base 179 and bar 152, thus preventing locking device 800 from being easily removed from hook 170 and bar 152.

Referring to FIGS. 12A-12I, an alternative locking device 900 for securing hook 170 to a crossbar 150 is shown in accordance with the present disclosure. The locking device 900 includes an upper housing 902 and a lower housing 950, where housings 902, 950 are secured in a locked state via a screw or other securing means 930.

Figure 12A:
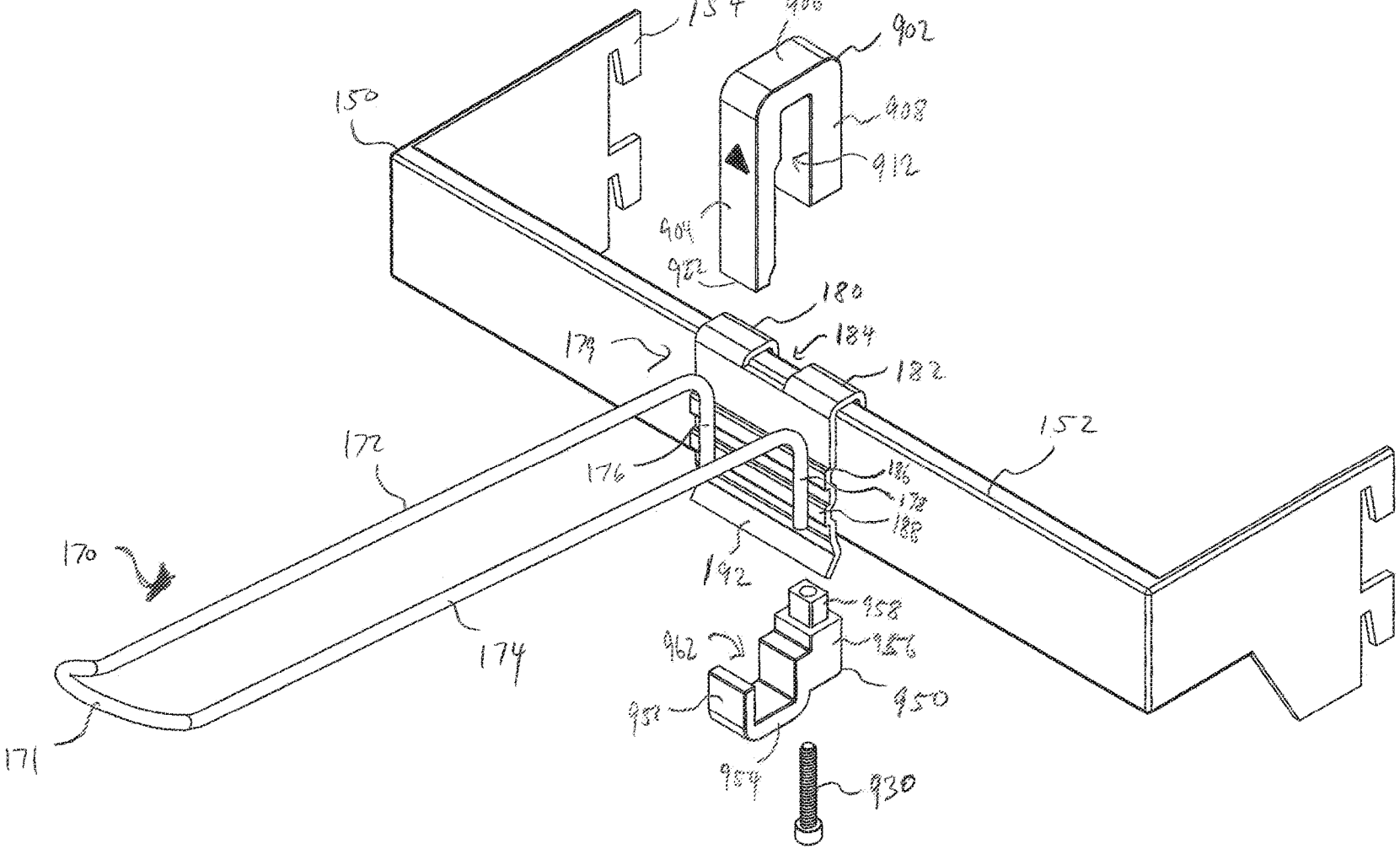
FIGS. 12A-12O include various views of an alternative locking device for securing the alternative crossbar hook of FIGS. 11A-11C to a crossbar in accordance with an embodiment of the present disclosure.
Figure 12B:
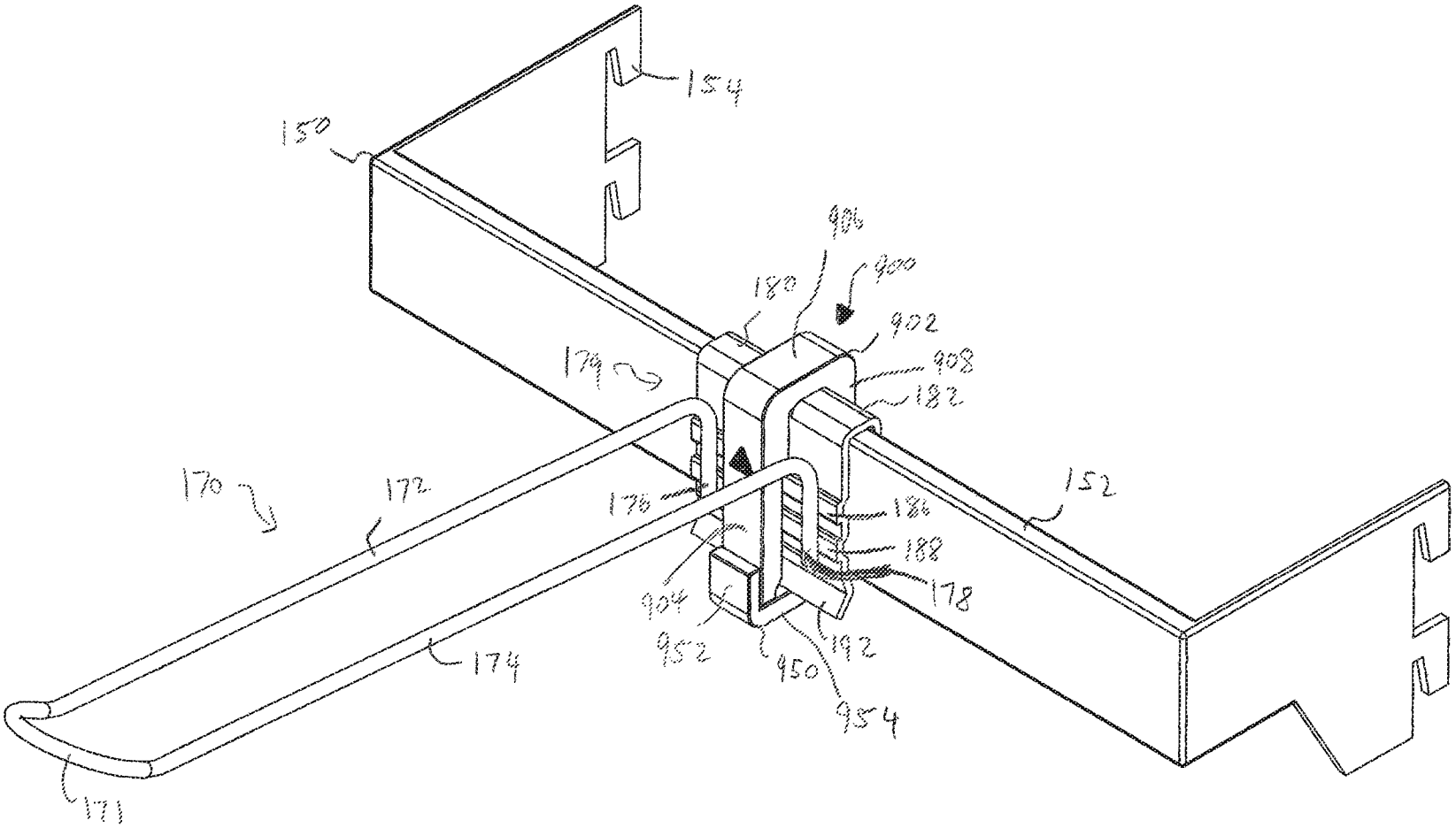
Figure 12C:
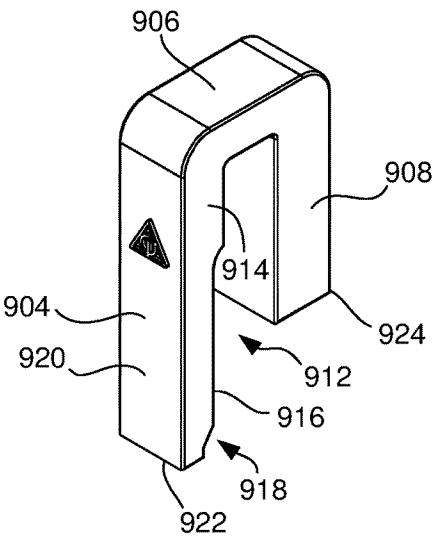
Figure 12D:
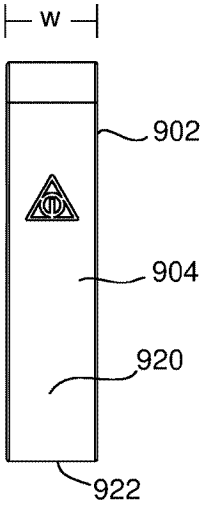
Figure 12E:
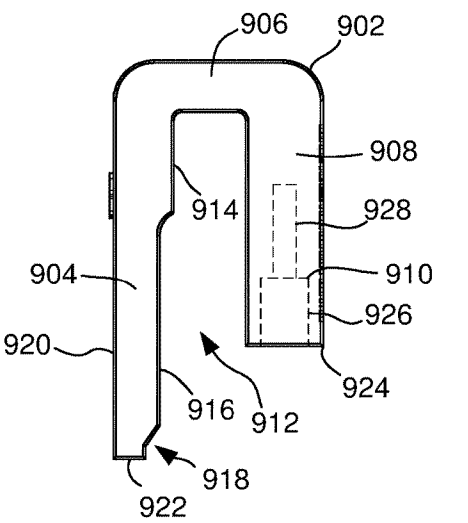

As shown in FIGS. 12C-12E, upper housing 902 is shown in greater detail. Housing 902 is configured in a generally u-shaped manner and includes portions 904, 906, 908, where an end of portion 904 is coupled to a first end of portion 906 and an end of portion 908 is coupled to a second end of portion 906. The inner surfaces of portions 904, 906, 908 define an interior 912. Portion 904 includes an end 922, an exterior surface 920, and an interior surface having portions 914, 916, 918. Portion 918 is disposed more proximately to surface 920 than portions 914, 916, and portion 916 is disposed more proximately to surface 920 than portion 914. Portion 908 includes an end 924 and a channel 910 disposed internally to portion 908), where channel 910 extends from end 924 of portion 908 toward portion 906. Channel 910 includes coaxial portions 926, 928, where portion 926 is disposed adjacent to end 924 and includes a larger diameter than portion 928. Portion 926 is configured to receive a portion of lower housing 950 (as will be described below) and portion 928 is configured to receive securing member (e.g., as screw) 930.

Figure 12F:
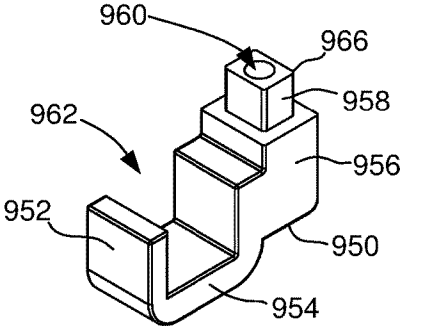
Figure 12G:
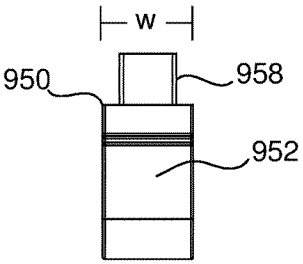
Figure 12H:
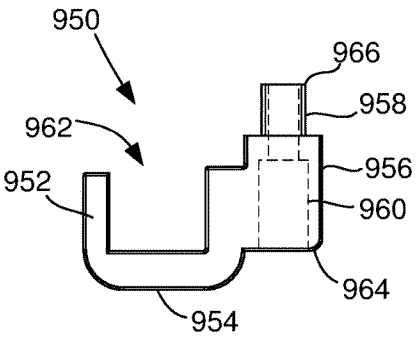

As shown in FIGS. 12F-12H, lower housing 950 is shown in greater detail. Housing 950 includes portions 952, 954, 956, where the inner surfaces of portions 952, 954, 956 form an interior 962. A first end of portion 952 is coupled to a first end of portion 954 and a first end of portion 956 is coupled to a second end of portion 956. Portion 956 includes an extension member disposed at end 966 of portion 956. Portion 956 further includes a channel 960 extends from end 964 to end 966, where channel 964 is configured to receive securing member 930.

Referring again to FIGS. 12A-12B, in use, while hook 170 is coupled to bar 152, upper housing 902 and lower housing 950 are disposed over base 179 of hook 170 and bar 152 of crossbar 150 between rods 172, 174, such that a portion of base 179 and a portion bar 152 are disposed in interiors 912, 962 and housings 902, 950 surround base 179 and bar 152. In this position, extension member 958 is received by lower portion 926 of channel 910, such that channels 910 and 960 align coaxially, portions 906 and 908 of housing 902 are received by slot 184, and end 922 of portion 904 is received by interior 962 of housing 950, such that end 922 is disposed adjacent to an interior surface of portion 952.

To maintain locking device 900 in a locked state, a securing member 930 is inserted through end 964 of portion 956 into channels 960, 910. With securing member disposed through channels 960, 910, locking device 900 prevents hook 170 from being removed from bar 152.

Figure 12I:
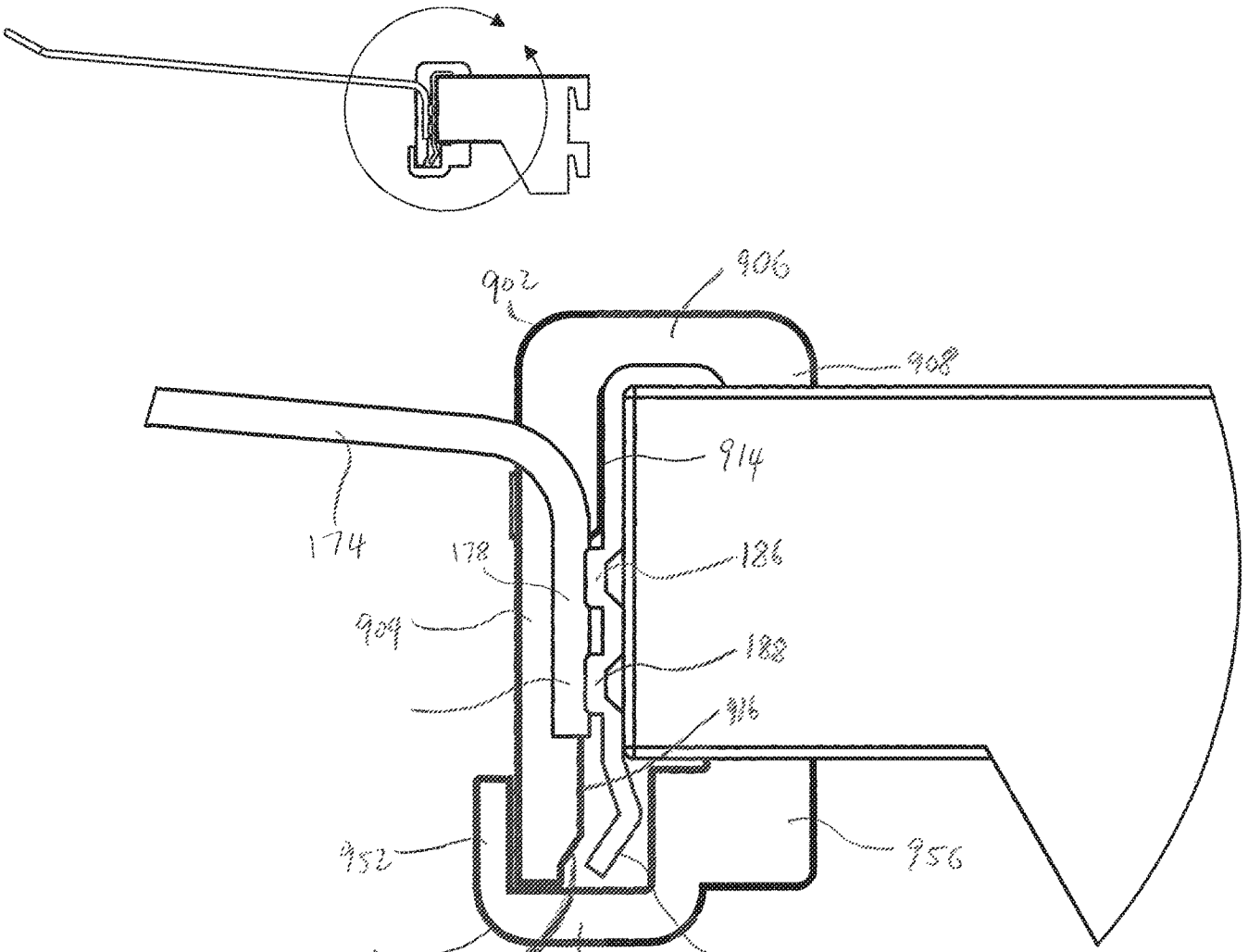
Figure 12O:
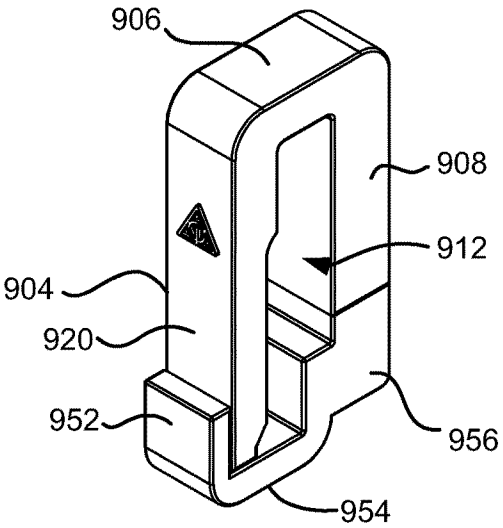
Figure 12K:
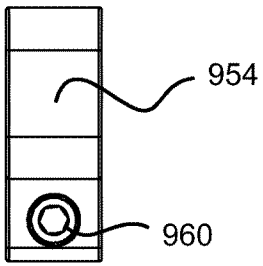
Figure 12N:
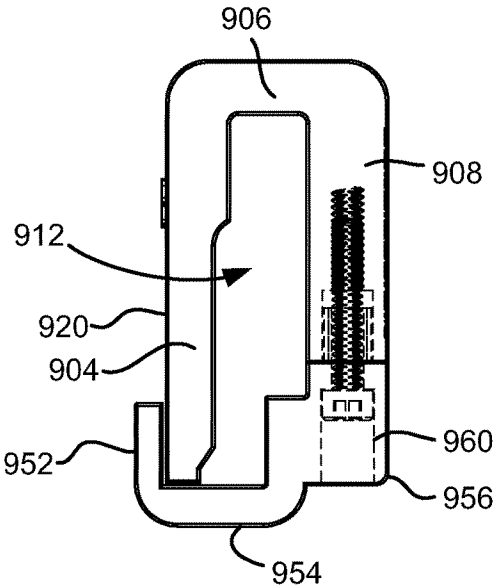
Figure 12J:
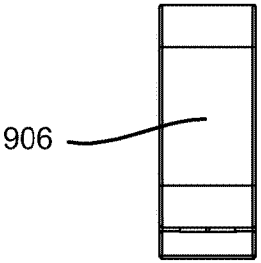
Figure 12M:
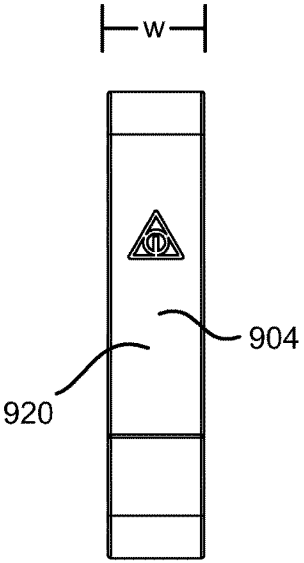
Figure 12L:
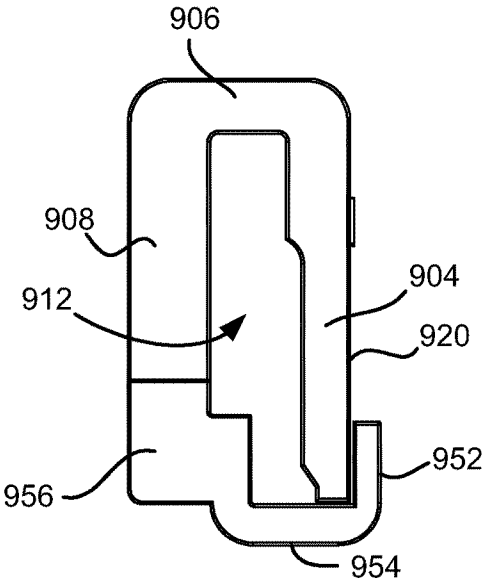

Referring to FIG. 12I, portion 916 of the interior surface of portion 904 is configured to receive or accommodate protrusions 186, 188 of base 179 and portion 918 of portion 904 is configured to receive or accommodate bent end 192, such that, the interior surface of portion 904 can be disposed as close as possible to base 179 to decrease any possible movement of hook 170 with respect to locking device 900 when locking device 900 is in a locked state.

It is to be appreciated that housings 902 and 950 each have a width w that is substantially equal to the width of slot 184 (or slightly less than the width of slot 184) to enable portions 906 and 908 of housing 902 and/or portion 956 of housing 950 to fit within slot 184. In this way, locking device 900 achieve a secure fit around crossbar hook 170 and cross bar 150. It is also to be appreciated that lower portion 926 of channel 910 is dimensioned in a similar manner to extension member 958 (i.e., portion 926 and member 958 each have a non-circular cross-section), such that when extension member 958 is disposed in lower portion 926 of channel 910, housings 902 and 950 cannot be rotated with respect to each other.

Referring to FIGS. 12J-12O, locking device 900 is shown assembled (i.e., with housing 902 coupled to housing 950 via a securing member).

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking device for preventing a slatwall hook from being removed from a slatwall, wherein the slatwall hook includes a rod and a base, the rod extending from the base and the base configured to be inserted into a slatwall slot of the slatwall to mount the slatwall hook thereto, the locking device comprising:

a housing including a first portion, a second portion, and a third portion;

the first portion and the second portion each configured as tabs and extending from the third portion;

the second portion offset by a predetermined distance from the first portion;

the third portion including a slot and a connecting portion, the connecting portion configured to connect the first portion to the second portion, wherein the slot is configured to receive a portion of the base of the slatwall hook, the second portion is configured to be inserted into the slatwall slot of the slatwall, and the first portion is configured to be disposed against an outer surface of the slatwall such that when the base of the slatwall hook is disposed in the slatwall slot, the first portion and second portion of the housing prevent the slatwall hook from being tilted with respect to the slatwall.

2. The locking device of claim 1, wherein the first portion and the second portion extend in opposite directions.

3. The locking device of claim 2, wherein the second portion extends into a lower portion of the slatwall slot and the base of the slatwall hook extends into an upper portion of the saltwall slot.

4. The locking device of claim 1, wherein the predetermined distance is selected based on a distance between a first portion of the base of the slatwall hook and a second portion of the base of the slatwall hook.

5. The locking device of claim 1, wherein the predetermined distance is selected based on a depth of the slatwall slot measured from the outer surface of the slatwall.

6. The locking device of claim 1, wherein the housing includes a second slot disposed though the first portion and the second portion, the slot configured to receive a securing member for securing the base of the slatwall hook received by the first slot between the securing member and the connecting portion to prevent the base of the slatwall hook from being removed from the first slot.

7. The locking device of claim 1, further comprising a clip including a clip housing and first and second securing members, the securing members coupling the clip housing to the third portion of the housing of the locking device, the clip housing configured with a surface area selected such that when the clip is coupled to the housing of the locking device, the clip housing contacts the surface area above and below the slot of the slat-wall to prevent twisting leverages and rotational torques from being applied to the locking device to remove the locking device from the slatwall hook and slatwall.

8. The locking device of claim 7, wherein the housing includes a first side and a second side and an extension member extending from the connection portion on the second side of the housing, the first securing member of the clip coupled to the third portion of the housing on the first side of the housing and the second securing member of the clip coupled extension member of the third portion of the housing on the second side of the housing.

9. The locking device of claim 8, wherein the surface area of the clip housing is selected to decrease the visibility and access to the slot of the locking device when the locking device is coupled to the base of the slatwall hook and the slatwall.

10. A locking device for preventing a slatwall hook from being removed from a slatwall, wherein the slatwall hook includes a rod and a base, the rod extending from the base and the base configured to be inserted into a slatwall slot of the slatwall to mount the slatwall hook thereto, the locking device comprising:

a housing including a first portion, a second portion, and a third portion;

the first portion and the second portion each configured as tabs and extending from the third portion in opposite directions;

the second portion offset by a predetermined distance from the first portion;

the third portion including a slot and a connecting portion, the connecting portion configured to connect the first portion to the second portion, wherein the slot is configured to receive the base of the slatwall hook, the second portion is configured to be inserted into the slatwall slot of the slatwall, and the first portion is configured to be disposed against an outer surface of the slatwall such that when the slatwall hook is coupled to the slatwall the first portion and second portion of the housing prevent the slatwall hook from being tilted with respect to the slatwall, wherein the predetermined distance the second portion is offset from the first portion is selected based on at least one of a depth of the slatwall slot measured from the outer surface of the slatwall and a distance between a first portion of the base of the slatwall hook and a second portion of the base of the slatwall hook.

11. A locking device for preventing a slatwall hook from being removed from a slatwall, wherein the slatwall hook includes a rod and a base, the rod extending from the base and the base configured to be inserted into a slatwall slot of the slatwall to mount the slatwall hook thereto, the locking device comprising:

a housing including a first portion, a second portion, and a third portion;

the first portion and the second portion each configured as tabs and extending from the third portion in opposite directions;

the second portion offset by a predetermined distance from the first portion, wherein the first portion and the second portion extend in opposite directions;

the third portion including a slot and a connecting portion, the connecting portion configured to connect the first portion to the second portion, wherein the slot is configured to receive the base of the slatwall hook, the second portion is configured to be inserted into a lower portion of the slatwall slot of the slatwall, and the first portion is configured to be disposed against an outer surface of the slatwall such that when the slatwall hook is coupled to the slatwall slot the first portion and second portion of the housing prevent the slatwall hook from being tilted with respect to the slatwall.

12. The locking device of claim 1, wherein the first portion is configured to be disposed against the outer surface of the slatwall above the slatwall slot.

13. The locking device of claim 12, wherein the base of the slatwall hook includes a first portion, a second portion, and a third portion, the first portion configured to be inserted into the slatwall slot, the second portion configured to be disposed against the outer surface of the slatwall below the slatwall slot, and the third portion configured to be received by the housing slot.

14. The locking device of claim 13, wherein the housing includes a first end and a second end, the first portion of the housing disposed towards the first end and the second portion of the housing disposed towards the second end, the first portion and second portion of the housing configured to prevent the slatwall hook from being tilted toward the first end of the housing, and the first portion and second portion of the base of the slatwall hook prevent the slatwall hook from being tilted toward the second end of the housing.

* * * * *